US011066199B2

(12) United States Patent
Kirzinger et al.

(10) Patent No.: US 11,066,199 B2
(45) Date of Patent: Jul. 20, 2021

(54) METHOD AND DEVICE FOR FORMING CONTAINER GROUPINGS

(71) Applicant: KRONES AG, Neutraubling (DE)

(72) Inventors: Johannes Kirzinger, Unterhaching (DE); Christian Hastreiter, Rosenheim (DE); Manuel Kollmuss, Raubling (DE); Richard Eschlbeck, Vogtareuth (DE); Heiner Schaefer, Munich (DE); Andreas Fritsch, Eggstätt (DE); Juergen Werner, Bruckmühl (DE); Thomas Wimmer, Rosenheim (DE); Herbert Spindler, Niedermoosen (DE); Christian Napravnik, Rosenheim (DE)

(73) Assignee: KRONES AG, Neutraubling (DE)

( * ) Notice: Subject to any disclaimer, the term of this patent is extended or adjusted under 35 U.S.C. 154(b) by 165 days.

(21) Appl. No.: 16/090,279

(22) PCT Filed: Dec. 29, 2016

(86) PCT No.: PCT/EP2016/082823
§ 371 (c)(1),
(2) Date: Oct. 1, 2018

(87) PCT Pub. No.: WO2017/167422
PCT Pub. Date: Oct. 5, 2017

(65) Prior Publication Data

US 2019/0112083 A1 Apr. 18, 2019

(30) Foreign Application Priority Data

Mar. 30, 2016 (DE) ..... 10 2016 105 807.6

(51) Int. Cl.
*B65B 11/00* (2006.01)
*B65B 11/58* (2006.01)
(Continued)

(52) U.S. Cl.
CPC ..... *B65B 11/008* (2013.01); *B65B 5/06* (2013.01); *B65B 5/08* (2013.01); *B65B 11/58* (2013.01);
(Continued)

(58) Field of Classification Search
CPC ..... B65B 11/58; B65B 11/585; B65B 21/245; B65B 27/04; B65B 35/44; B65B 35/50;
(Continued)

(56) References Cited

U.S. PATENT DOCUMENTS 4,077,516 A * 3/1978 Duerr ..... B65D 71/0085 206/432
4,289,236 A * 9/1981 Ganz ..... B65B 53/02 206/432
(Continued)

FOREIGN PATENT DOCUMENTS

DE 102012000340 A1 7/2013
DE 102013106368 A1 12/2014
(Continued)

OTHER PUBLICATIONS

International Preliminary Report on Patentability/Written Opinion for PCT/EP2016/082823.
(Continued)

*Primary Examiner* — Hemant Desai
*Assistant Examiner* — Christopher Robin Kim
(74) *Attorney, Agent, or Firm* — Schmeiser, Olsen & Watts, LLP

(57) ABSTRACT

Provided is a method for packaging piece good groupings, in which a plurality of piece goods, particularly containers, are at least partially interconnected by a first connector, wherein at least two-piece goods of this plurality are directly interconnected by the connector. According to the embodiment, this plurality of piece goods connected by the con-
(Continued)

nector is packaged with a second connector in the form of a second wrapping element, and said plurality of piece goods connected by a first connector is conveyed by a conveyor device to a packaging device and enclosed, particularly wrapped, with the second wrapping element by said packaging unit.

10 Claims, 14 Drawing Sheets

(51) Int. Cl.

| | |
|---|---|
| ***B65B 21/24*** | (2006.01) |
| ***B65B 27/04*** | (2006.01) |
| ***B65B 35/44*** | (2006.01) |
| ***B65B 35/50*** | (2006.01) |
| ***B65B 35/54*** | (2006.01) |
| ***B65B 35/58*** | (2006.01) |
| ***B65B 5/06*** | (2006.01) |
| ***B65B 5/08*** | (2006.01) |
| ***B65D 71/10*** | (2006.01) |
| ***B65D 71/08*** | (2006.01) |

(52) U.S. Cl.
CPC ..... *B65B 11/585* (2013.01); *B65B 21/245* (2013.01); *B65B 27/04* (2013.01); *B65B 35/44* (2013.01); *B65B 35/50* (2013.01); *B65B 35/54* (2013.01); *B65B 35/58* (2013.01); *B65D 71/08* (2013.01); *B65D 71/10* (2013.01); *B65B 2220/16* (2013.01); *B65B 2230/00* (2013.01); *B65B 2230/02* (2013.01)

(58) Field of Classification Search
CPC ..... B65B 35/54; B65B 35/58; B65B 5/06; B65B 5/08; B65B 2230/00; B65B 2220/16; B65B 2230/02; B65B 35/30; B65B 11/008; B65D 71/08; B65D 71/10
See application file for complete search history.

(56) References Cited

U.S. PATENT DOCUMENTS

| | | | | |
|---|---|---|---|---|
| 4,633,647 | A * | 1/1987 | Ganz | B65B 21/245 53/233 |
| 4,730,436 | A * | 3/1988 | Angelino | B65B 11/58 53/170 |
| 4,932,528 | A * | 6/1990 | Benno | B65D 71/10 206/144 |
| 4,971,197 | A * | 11/1990 | Worley | B65D 71/08 206/705 |
| 6,021,890 | A * | 2/2000 | Focke | B65B 11/58 206/391 |
| 9,708,085 | B2 * | 7/2017 | Moore | B65D 85/07 |
| 2002/0069618 | A1 * | 6/2002 | Otsuka | B65B 5/067 53/434 |
| 2003/0097817 | A1 * | 5/2003 | Cere | B65B 21/245 53/398 |
| 2004/0107678 | A1 * | 6/2004 | Cere | B65B 21/245 53/588 |
| 2011/0147258 | A1 * | 6/2011 | Hartness | B29C 66/431 206/497 |

FOREIGN PATENT DOCUMENTS

| | | | |
|---|---|---|---|
| DE | 102013106742 | A1 | 12/2014 |
| DE | 102013112151 | A1 | 5/2015 |
| EP | 0197574 | A1 | 10/1986 |
| WO | WO8805016 | A1 | 7/1988 |

OTHER PUBLICATIONS

International Search Report PCT/EP2016/082823.
Chinese Office Action dated Jan. 6, 2020 for Application No. 201680083089X.

* cited by examiner

Fig. 19
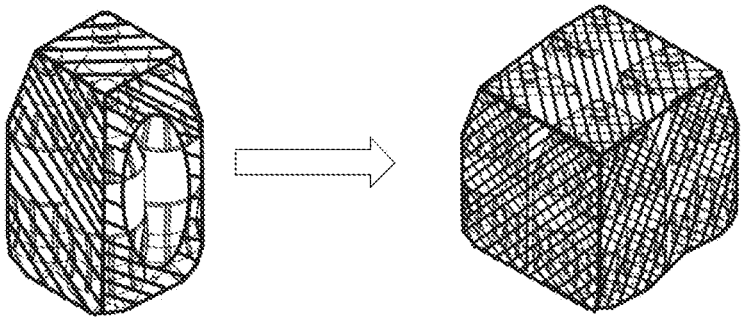
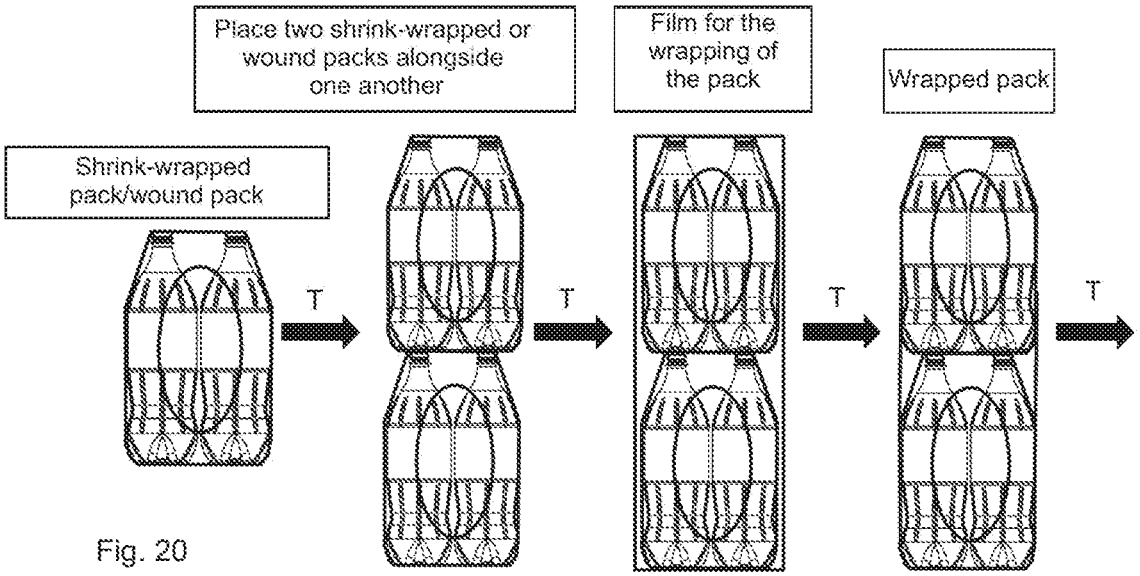
Fig. 20
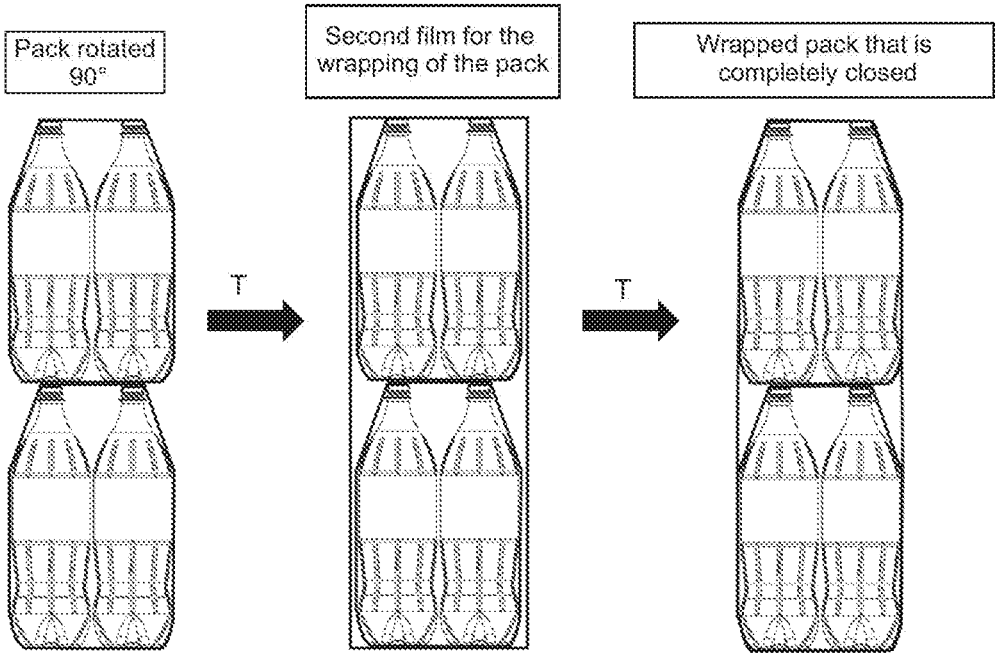
Fig. 21

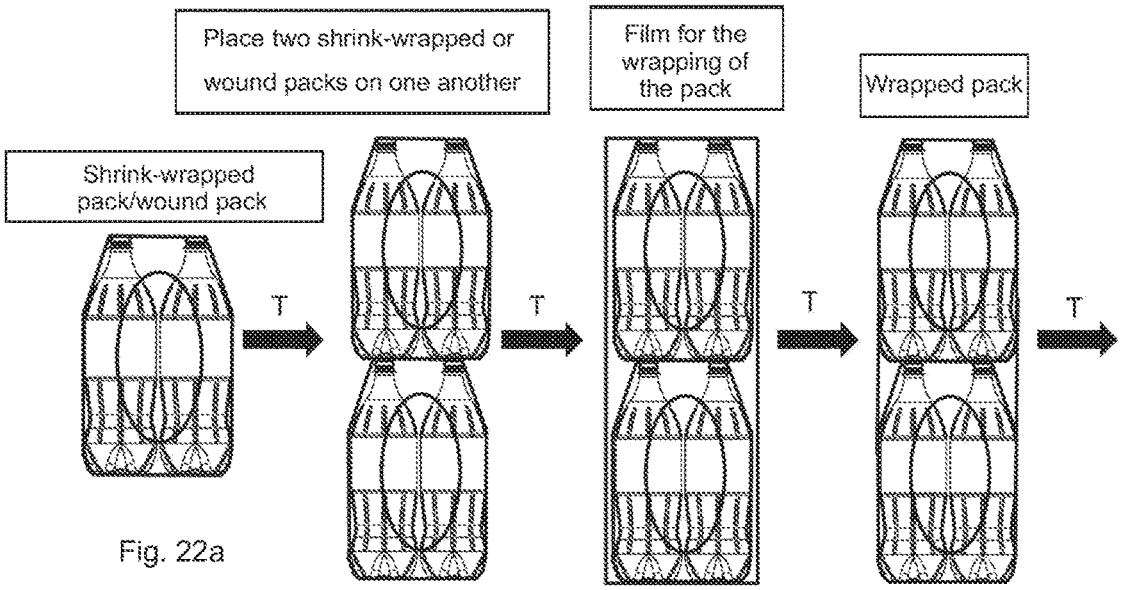
Fig. 22a
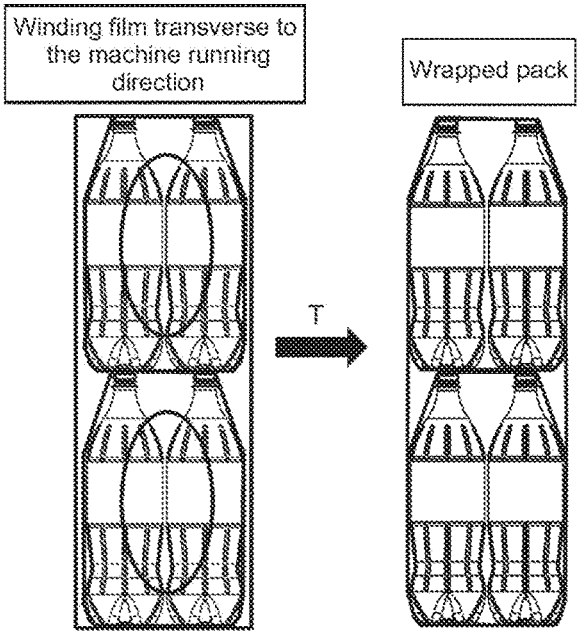
Fig. 22b
Fig. 23
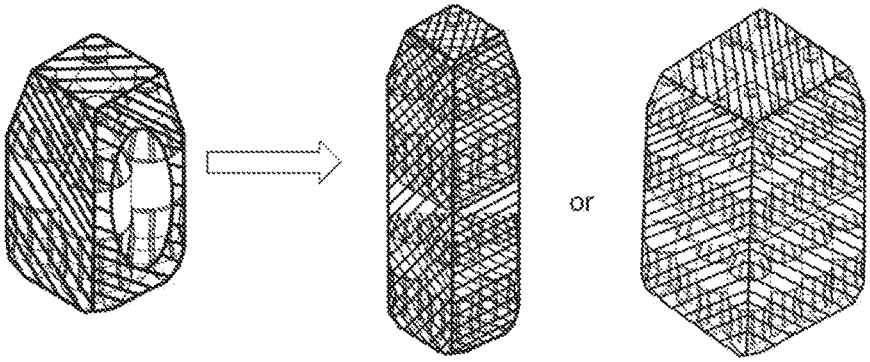

METHOD AND DEVICE FOR FORMING CONTAINER GROUPINGS

CROSS-REFERENCE TO RELATED APPLICATIONS

This application claims priority to PCT Application No. PCT/EP2016/082823, having a filing date of Dec. 29, 2016, based on German Application No. 10 2016 105 807.6, having a filing date of Mar. 30, 2016, the entire contents both of which are hereby incorporated by reference.

FIELD OF TECHNOLOGY

The following relates to a method and a machine for forming piece good groupings, in particular container groupings and in particular wrapped piece good groupings. Such methods and machines have been known for a long time from the known art.

BACKGROUND

Thus, it is for example known that groupings of containers, for example containers delivered in two rows, are provided with a film and this film is then shrunk onto these containers. In order to achieve this, in the known art so-called shrink tunnels are provided, through which the containers are transported. In addition, however, in the known art methods and machines have become known more recently in which such container groupings are wrapped with a stretchable film.

In the past, for example, methods for producing double-row wound packs have been known, wherein a double-row stream of bottles is wrapped around with a film, in particular a so-called stretch film, and then packs are isolated by means of a cutting device. A disadvantage of this procedure is that as a rule only double-row packs can be produced, and multi-row packs cannot be produced, since in particular the containers in the middle cannot be held by the stretch film and can slide out of the pack, for example downwards.

In addition, the packs produced are open laterally. In this way it is usually not possible to produce a completely closed pack. Advantageously, in the methods and packaging plants for producing such film packages which are known in the known art, the continuously conveyed film packages are severed in particular at defined points, which can take place for example by means of a cutting device which is passed, in particularly vertically, through the film packages between successive pairs of containers, so that in each case a pack with four, six or eight containers is separated off, which retains the required mechanical stability in spite of the partially open end faces in the case of double-row containers.

SUMMARY

An aspect relates to a possible means by which multi-row packs or generally larger packs can be produced. In addition, a possibility should preferably also be created for producing a pack which is at least substantially and preferably fully enclosed. However, it is pointed out that possibly both of the said aspects are not necessarily achieved by the same configuration of the invention.

In the method according to embodiments of the invention for packaging piece good groupings a plurality of piece goods, in particular piece goods of the same kind and in particular containers, are delivered by means of a transport device along a predetermined transport direction. Furthermore, this plurality of piece goods is packaged and/or assembled by means of a first wrapping element which at least partially surrounds the plurality of piece goods. Furthermore, the plurality of piece goods packaged with the first wrapping element is packaged with a second wrapping element and for this purpose the plurality of piece goods packaged with the first wrapping element are wrapped by a wrapping device with a wrapping element in the form of a stretchable film element, wherein this wrapping preferably takes place about a longitudinal axis defined by the transport direction.

Packaging of the piece good grouping is understood in particular to mean that the individual piece goods of this piece good grouping are also held together at least temporarily by this wrapping element.

According to embodiments of the invention at least one further piece good is delivered to the plurality of piece goods packaged with the first wrapping element, and the grouping of piece goods packaged with the first wrapping element and the at least one further piece good is wrapped with the second wrapping element.

The first wrapping element is advantageously a film element and in particular a stretchable film element. However, it would also be conceivable that the first wrapping element is a strip-like wrapping element which is laid around the piece good grouping or is arranged thereon. The first wrapping element can also be a shrink wrap film which in particular has been shrunk onto the containers or the piece goods. In general, the wrapping elements are preferably elongate, in particular strip-shaped wrapping elements which extend in particular in a longitudinal direction and additionally, albeit to a large extent, in a transverse direction perpendicular thereto. These wrapping elements are preferably available in a rolled-up form and can be for example unwound from a carrier roll. The wrapping elements are preferably elements produced from a material containing plastic or paper.

Therefore, in this embodiment it is proposed that first a piece good grouping provided with a wrapping element is provided, further piece goods are then delivered thereto and then the grouping is again surrounded by a wrapping element in the form of a film element. Advantageously the piece good grouping surrounded by the first wrapping element is a double-row pack. However, it would also be conceivable that this piece good grouping is already a three-row or multi-row pack. It could also be merely a single-row pack.

In addition, it would also be possible that two or more piece good groupings already in each case combined with a first wrapping element are enclosed by the second wrapping element and thus are grouped together into a large package.

Thus, the embodiment describes a possibility, as described above, first for producing a for example double-row pack and to produce a stable, multi-row pack by addition for example of single-row streams of bottles and further packaging and in particular further winding. In this case, as set out in greater detail below, the possibility exists that the shrink-wrapped pack or the pack produced by a winding method is rotated by a predetermined angle, for example 90°, and again enclosed by a film, such as a winding film, in order thus to produce a completely enclosed pack.

Thus in a further method according to embodiments of the invention for packaging piece good groupings a plurality of piece goods, in particular piece goods of the same kind and in particular containers, are likewise delivered by means of a transport device along a predetermined transport direction, and this plurality of piece goods are packaged by means of a first wrapping element, wherein the first wrapping element surrounds the plurality of piece goods at least partially and wherein the plurality of piece goods packaged with the first wrapping element is packaged with a second wrapping element and for this purpose the number of piece goods packaged with the first wrapping element are wrapped by a wrapping device with the stretchable film element, wherein this wrapping preferably takes place about a longitudinal axis defined by the transport direction.

Advantageously the first wrapping element and the second wrapping element, which is a film element, are attached to the piece goods in such a way that the piece goods are completely enclosed by the totality of the first film element and the second film element. This may be understood to mean that this enclosing does not necessarily always take place by both wrapping elements, but also either the one or the other film element, considered jointly, close off all the regions of the piece good grouping. Advantageously here the first wrapping element can also be a stretchable film or a stretch film, but shrinking on of a film, as explained above, would also be possible.

Advantageously the piece goods are transported lying against one another or touching one another. Also, in the grouping thus formed at least two-piece goods touch one another. Preferably a plurality of piece goods in each case touch one another with their circumferential wall.

A further object of embodiments of the invention is to improve the stability of such piece good groupings. Accordingly, in a further method according to embodiments of the invention for packaging piece good groupings, it is proposed that a plurality of piece goods, particularly containers, are at least partially interconnected by means of a first connector, wherein at least two of these piece goods are fastened directly to one another.

According to embodiments of the invention, this plurality of piece goods connected at least partially by the connector is packaged with a second connector in the form of a second wrapping element or covering element, and for this purpose the plurality of piece goods connected by a first connector is transported by means of a transport device to a packaging device and is wrapped and/or enclosed with the second wrapping element by said packaging device.

In this variant of embodiments of the invention it is proposed that first a piece good grouping is provided in which the at least two containers and preferably a plurality of containers in each case are interconnected by the connector. In order to increase the stability of this piece good grouping, this piece good grouping is surrounded by a further wrapping or covering element and in particular a plastic element, in particular a film element.

An interconnection of the containers is understood in particular here to mean that a plurality of containers is not connected to one another by a common element, such as for instance an enclosing strip, but in each case one container is connected directly to a further container. Thus, for example a container can be connected by force fitting to a further element. In this case in particular a wall of a container can be fastened to a wall of a further container.

The second wrapping element is advantageously a stretchable film element, as described above. Instead of a stretchable film element, however, a wrapping strip could also be used or also a shrink wrap film.

In a further advantageous method this winding takes place with the second wrapping element about a longitudinal axis defined by a transport direction. In this case the transport direction is again the transport direction in which the containers of the above-mentioned packaging device are delivered and/or in which the containers are guided through this packaging device. With this method the aspects described above and also the aspects still to be described below can be applied correspondingly.

In a further advantageous embodiment, the connector is a flowable connector and in particular an adhesive. In this case a cold adhesive or also a hot melt adhesive can be used. Furthermore, this could be an acrylate adhesive. It would also be conceivable that adhesion points are arranged at specific regions on the containers. Thus, for example adhesion points could be arranged on the outer surfaces of the containers. In addition, the containers could also be welded to one another. In this case this adhesive is advantageously applied to an outer surface of the containers.

In this case it would also be possible that the adhesive is applied to an outer wall of already filled containers. In a further advantageous embodiment, a plurality of containers and preferably also all containers are connected to one another by the connector.

In a further preferred method, the connector holds at least two of the piece goods of the piece good grouping directly together. The packaging means advantageous holds at least three of the piece goods of the piece good grouping together. In this case it is possible that every piece good and in particular every container is connected and in particular directly connected to at least two further containers. In addition, it would also be conceivable that more than two of the containers are connected to more than two further containers or generally piece goods. In this case at least one, preferably a plurality of and particularly preferably each piece good is advantageously connected directly to its closest neighbour.

In a further preferred method, the connector holds together at least two of the piece goods arranged externally with regard to the piece good grouping. This embodiment is based on the idea that in a wrapped piece good grouping the outer containers are often at particular risk of falling out. If here this outer containers are connected to one another or to inner container by a connector, such as an adhesive, all too easy falling out of precisely these containers can be prevented. Advantageously at least the piece goods of an outer row of this piece good grouping are connected to one another or to inner rows by the connector.

Each of the piece goods arranged externally with respect to the piece good grouping is advantageously connected by the connector to at least one further piece good.

Advantageously each piece good is connected to at least two further piece goods by the connector. Thus, for example it would also be possible that the piece goods are provided in a plurality of rows and in each row the individual piece goods are connected to one another by the connector.

In a further preferred method on the piece good grouping a grip element is arranged on the piece good grouping. In this case it is preferably possible that on the already wrapped piece good grouping a grip element is arranged, and in particular this grip element is arranged on a film element, for example adhered thereto. However, it would also be possible that the grip element is fastened directly to the piece goods and this grip element is wrapped at least partially by the wrapping element. In this way it can be possible that first during opening the film element is removed and then the grip element is accessible. However, it would also be possible that the grip element is fastened to a region of the piece good grouping at which no wrapping element is located, for example on a plan which is perpendicular to the transport direction or the wrapping direction.

Because a grouping of piece goods at least partially adhered to one another is already delivered to the wrapping device here, it is advantageously possible to omit the lateral guiding devices which are otherwise included in the wrapping, since the containers are already retained on one another.

Likewise, due to the use of a piece good grouping which is already at least partially adhered it would also be possible to omit the stationary carrier onto which the piece good grouping is fitted in order then to be wrapped jointly therewith. Instead of this it would actually be conceivable that the already at least partially adhered piece good grouping is pushed away via a gap and the wrapping is introduced into this gap.

By the use of a second wrapping in these embodiments it is also possible to reduce the weights of applied adhesive and thus the quantities of adhesive relative to methods known from the known art. Thus, it would be possible that the containers are already held against one another with a smaller quantity of adhesive and/or a smaller number of adhesion points so well that together with the outer wrapping a stable pack is produced. In addition, the adhesion between the containers can also be used merely in order to obtain a more stable intermediate product which can be better handled during the further processing.

The film element is advantageously a plastic film and in particular a stretchable plastic film. This plastic film preferably has a thickness between 3 μm and 50 μm, preferably between 5 μm and 30 μm, particularly preferably between 8 μm and 14 μm and particularly preferably between 8 μm and 12 μm. The film element is preferably a transparent film element.

In this case the film element is preferably attached to the piece good grouping in at least one full revolution in the circumferential direction. In addition, however, it would also be conceivable that the piece good grouping is wrapped a number of times with the film element.

In a further advantageous embodiment, the conveying direction is rectilinear. The piece goods can be in particular plastic bottles or glass bottles. However, an application to other containers, such as for instance cans or so-called pouches, would also be conceivable.

In a further advantageous embodiment, the first wrapping element and/or the second wrapping element can be arranged in such a way that it wraps spirally around the grouping.

Furthermore, within the context of embodiments of the invention it would also be conceivable for example to group and/or to stack shrink-wrapped packs or smaller wound packs and to wrap them again. In this case this method according to embodiments of the invention could also be used as a substitute for so-called shrink-to-shrink methods, in which the grouped and/or stacked packs are with surrounded with shrink wrap film surrounds and are shrink-wrapped. Such a shrink-to-shrink method actually bears the risk that the film of the smaller packs is bonded or welded to the "collecting film". In addition, the winding process described here is more favourable than the winding process in terms of energy.

Overall the embodiment makes possible a procedure which is more favourable in terms of energy and also a reduction in packaging material. In particular a solution for unprinted low-cost packs and transport packaging can also be created in this way.

In a further advantageous variant of the method a position of the piece goods provided with the first film element or the first wrapping element relative to the transport direction is changed before the attachment of the film element or of the second wrapping element. Advantageously in this case the piece good grouping is rotated in particular relative to the transport device. In this case a rotation by a defined angle, for example by 90°, advantageously takes place. Particularly preferably in this case a rotation takes place with respect to an axis of rotation which is perpendicular to the transport device and/or to a transport plane in which the piece goods are transported.

In this way an opening which remains during the first winding process with the first packaging device can also be covered by the second wrapping element.

For this purpose, it would be possible for example that the machine has a gripping device which grips the piece good grouping and rotates about a defined angle. However, such a displacement and in particular rotation can also take place in order then, in a rotated position in a particularly convenient manner, to add further containers to the piece good grouping.

In a further advantageous method at least two further piece goods are delivered to the plurality of piece goods packaged with the first wrapping element and/or to the plurality of piece goods at least partially connected to the connecting element. Thus, for example a piece good grouping of six containers can be produced by the first wrapping element and for example two or three further containers can be added to these six containers. However, it would also be possible that a second piece good grouping is added to the first piece good grouping. Thus, it would be possible for example that by means of the first wrapping element two-piece good groupings are formed, these are then moved close to one another and are surrounded by the second wrapping element and in particular the film element.

Combinations of the methods described here are also conceivable. Thus, for example first a piece good grouping could be produced by at least partial adhesion of individual piece goods, these could then be wrapped with a film element and at least one further piece good could be added to this piece good grouping and then the entire grouping could be wrapped again. Also, first a piece good grouping could be produced which is connected together at least partially by an adhesive joined produced, further piece goods (in particular loose) could be added to this and then the resulting grouping could be wrapped.

In this case these piece goods are preferably similar piece goods, for instance containers, which are filled with the same drink. However, it would also be possible that they are different types of piece goods, for instance containers which are filled with different beverages. They could also be piece goods of different generic types, for instance in the case where a promotional item, such as for instance a drinking glass or a bottle opener, is to be added to a group of containers.

Generally, with this procedure further piece goods are delivered to the grouping, for instance delivered laterally. A delivery of the further containers advantageously takes place on precisely one side wall of the first grouping. However, it would also be possible that containers are added both on one side and also on a second (in particular opposing) side of the piece good grouping. In addition, it would be possible that this operation is repeated, and, for example, two containers are delivered to the piece good grouping, these are then wrapped with the film element and further piece goods are added to the pack thus produced.

In a further preferred method at least two further piece goods are oriented parallel to one another and/or the at least two further piece goods are also oriented parallel to the plurality of piece goods. Thus, for example it is possible that a plurality of containers are grouped together in the first piece good grouping and these are conveyed, each standing upright, on a conveyor belt. Two further containers, likewise standing upright and thus oriented parallel can for example be added to this grouping.

In a further advantageous embodiment, the plurality of piece goods which are already wrapped with the first wrapping element and to which a further piece good has already been added are transported on a carrier in such a way that the at least one-piece good bears against the plurality of piece goods. Thus, for example it is possible that the first piece good grouping is wrapped by a film and then to a certain extent outside the film the further piece goods, such as in particular containers, are added. Advantageously the carrier on which piece goods are wrapped is a stationary carrier. In this case this carrier is also advantageously wrapped around by a wrapping device and then the piece good grouping is pulled down or pushed down from this carrier.

In addition, lateral guiding elements can also be provided, which can likewise be included in the wrapping and from which the piece good grouping is subsequently pulled down In a further advantageous method, the plurality of piece goods packaged with the first wrapping element and/or the plurality of piece goods at least partially connected to or packaged with the connecting element are pushed in the transport direction onto the (in particular stationary) carrier. In this case further containers can be added, for example in the transport direction downstream or upstream of the first piece good grouping, but also alongside or above it. This is explained in greater detail with reference to the drawings.

In a further preferred method at least one portion of the piece good grouping wrapped with the second wrapping element is separated from a further portion of the piece good grouping wrapped with the second wrapping element. This means that in this case a piece good grouping, in particular a continuously further transported piece good grouping, is formed with a plurality of piece goods, and these are then separated again. Thus, the wrapping films are for example cut again at a later stage and thus the piece good groupings are divided into arbitrary or required units. For this separation a guillotine-like separating element, for example a blade, can be used for example, which moves downwards in a perpendicular direction with respect to the transport direction and thus cuts at least one of the two wrapping elements and in particular the film element. In this case this separating element is preferably moved at least temporarily with the piece goods. In this case this movement of the separating element can also be synchronise with the movement of the piece goods.

In a further advantageous method, a plurality of piece goods are positioned in such a way that the second film element substantially completely frees an opening of the first wrapping element attached to the piece goods. In this case overall a piece good grouping can be formed which has no direct opening to the environment. In this case subsequent contamination of these piece good groupings can be counteracted.

In this case for example the second wrapping element or film element can advantageously be wound transversely with respect to the transport direction around the piece goods. In this case are different types of process are conceivable. Thus, the first piece good grouping can be a shrink-wrapped pack which is rotated so that also the openings or eyes systematically produced in this case are covered.

Furthermore, the following is directed to a piece good grouping with a plurality of piece goods, wherein at least some of the piece goods are in particular containers which are at least partially surrounded by a first wrapping element and which are at least partially surrounded by a second wrapping element, wherein at least the second wrapping element is designed as a stretchable plastic film and wherein the first wrapping element and the second wrapping element bear against one another at least in some regions and wherein the first wrapping element bears directly against at least one of the piece goods.

According to embodiments of the invention at least one portion of the first wrapping element extends at least partially between two-piece goods and preferably separates them from one another.

Thus, in this embodiment first the first wrapping element is placed onto a first plurality of piece goods and holds them. Then further containers are added, and the aggregation is in turn surrounded by the second wrapping element, that is to say the film element. In this way at least one portion of the first wrapping element is located between one of the originally packaged containers and one of the newly added containers. This portion of the first wrapping element advantageously forms a line and/or plane, in particular between the original piece goods and the newly added piece goods.

Furthermore, the following is directed to a piece good grouping with a plurality of piece goods and in particular containers, which are at least partially surrounded by a first wrapping element and which are at least partially surrounded by a second wrapping element, wherein at least the second wrapping element is designed as a stretchable plastic film and wherein the first wrapping element and the second wrapping element bear against one another at least in some regions and wherein the first wrapping element bears directly against at least one of the piece goods.

According to embodiments of the invention at first geometric line extending in a radial direction of at least one first piece good passes through both film elements and at least one second geometric line extending in a radial direction of at least one second piece good of this piece good grouping passes through only one film element and/or the first wrapping element and the second wrapping element, which is a film element, are attached to the piece goods in such a way that the piece goods are completely enclosed by the totality of the first film element and the second film element.

Additionally, or alternatively it would also be conceivable that each geometric line always passes through at least two wrapping elements. In this embodiment it would be possible for example that two-piece good groupings formed by a first wrapping element are in turn grouped together and surrounded by a film element. In this case here too it is again possible that the second film element covers an opening and, in this case, the geometric line only passes through one wrapping element and in particular one film element. In addition, it is also possible that the wrapping elements lie one above the other in some regions, so that both are passed through. If, as mentioned, further containers are delivered to the first container, only the second wrapping element bears against these further containers.

Furthermore, the following is directed to a piece good grouping with a plurality of piece goods and in particular containers, which are at least partially connected (in particular to one another) by means of a first connecting element, wherein this first connecting element is an adhesive which holds at least two-piece goods of this piece good grouping against one another.

According to embodiments of the invention the piece good grouping is surrounded and in particular wrapped at least partially by a second wrapping element. Here "at least partially" is understood to mean that the piece good grouping does not necessarily have to be fully enclosed by the wrapping element.

Thus, here too it is proposed that first a piece good grouping is held together with a first connecting element, in this case in particular an adhesive, and this grouping is additionally wrapped by a further wrapping element and in particular a film-like wrapping element.

Advantageously—as mentioned above—a plurality of containers or piece goods of this piece good grouping are in each case connected to the connecting element and in particular directly connected to the connecting element.

Advantageously, here too at least the second wrapping element is again a stretchable plastic film. In addition, however—as mentioned above—a strip could also be used as wrapping element. Advantageously no portion of the film element is in contact with the connector. Advantageously the connector is only formed on those contact surfaces on which two-piece goods and in particular containers of these piece good grouping contact one another. This is in particular a basic body of the containers. The containers are advantageously containers which are similar with regard to their geometry.

Alternatively, it would also be conceivable that at least two containers are arranged one above the other in the longitudinal direction of these containers. In this case the outer walls of the respective wrappings partially bear against one another.

The first plurality of piece goods is advantageously a plurality of piece goods delivered in a double row. Advantageously the entire piece good grouping has at least one axis of symmetry with respect to the piece goods.

In a further advantageous embodiment at least, one further wrapping element bears in multiple layers on at least one piece good. Thus, it would be possible that at least one piece good or one-piece good grouping has been wrapped a number of times, for example at least twice.

Furthermore, the following is directed to a machine for the production of piece good groupings. This machine has a transport device which transports a plurality of piece goods in a predetermined transport direction. Furthermore, the machine has a first packaging device, which applies a first wrapping element to the plurality of piece goods in such a way that this first wrapping element at least partially surrounds the plurality of piece goods. Furthermore, the machine has a second packaging device, which is arranged in particular downstream with respect to the first packaging device in the transport direction of the piece goods, and which applies a second wrapping element in the form of a film element to the plurality of piece goods provided with the first wrapping element.

In this case this second packaging device is suitable and intended so that the plurality of piece goods provided with the first film element are wrapped with the second film element.

According to embodiments of the invention the machine has an adapting device which is arranged in the transport direction between the first packaging device and the second packaging device and which adds a further piece good to the plurality of piece goods provided with the first film element. Thus, in this embodiment it is proposed in terms of the apparatus that further containers are added to the grouping between the two packaging devices. In this case these further containers are preferably only wrapped by the second wrapping element wrapped, but not by the first wrapping element.

Furthermore, the following is directed to a machine for the production of a piece good grouping which has a transport device which transports a plurality of piece goods in a predetermined transport direction. Furthermore, the machine has a first packaging device, which applies a first wrapping element to the plurality of piece goods in such a way that this first wrapping element at least partially surrounds the plurality of piece goods. Furthermore, a second packaging device is provided which applies a second wrapping element in the form of a film element to the plurality of piece goods provided with the first wrapping element, wherein this second packaging device is suitable and intended so that the plurality of piece goods provided with the first film element are wrapped with the second film element.

According to embodiments of the invention the machine has an adapting device which is arranged in the transport direction between the first packaging device and the second packaging device and which changes a geometric position of the first plurality of piece goods relative to the transport device. This may advantageously be a rotating device which rotates the piece good grouping relative to the transport direction and in particular rotates about an axis which is perpendicular to the transport direction.

In addition, it would also be conceivable that the second packaging device is oriented differently from the first packaging device, so that holes or open points which ensue during the wrapping with the first wrapping element can be closed.

Furthermore, the following is directed to a machine for the production of a piece good grouping which has a transport device which transports a plurality of piece goods in a predetermined transport direction. Furthermore, the machine has a first packaging device, which fastens at least two of these piece goods to one another by means of a connecting element. Furthermore, the machine has a second packaging device which applies a second wrapping element designed in particular as a film element and/or strip-like element to the piece good grouping at least partially interconnected by the connecting element, wherein this second packaging device is suitable and intended so that the plurality of piece goods at least partially connected by the connecting element are wrapped and/or surrounded by the second wrapping element.

Thus, in terms of the system it is also proposed here that first a piece good grouping with at least one, advantageously a plurality of containers fastened to one another is produced and this then in turn further processed and in particular is wrapped with the further wrapping element. The container grouping is advantageously designed in the manner described above, i.e. in that each outer container of this piece good grouping is connected to at least two further containers. In this case it is possible that first the first packaging device applies an adhesive to a region of the outer wall of the containers and then delivers further containers to these positions, so that as a result adhesion of at least two containers occurs.

In a further advantageous embodiment the apparatus has a carrier for supporting the piece goods (in particular during wrapping with the first wrapping element), as well as a removal device, which removes the plurality of piece goods provided with the second wrapping element from this carrier, wherein the removal device is arranged upstream or downstream of the packaging device in the transport direction of the piece goods. This removal device can be for example a traction unit which, if required, engages a piece good grouping laterally and pulls it off from the said carrier. Advantageously the said carrier is also wrapped by at least the second wrapping element. In this case this carrier can preferably be formed as a sliding surface, relative to which the piece goods can slide with a low coefficient of friction.

In a further advantageous embodiment, the transport device conveys the piece good grouping in such a way to at least one of the two packaging devices that at least one piece good of the piece good grouping is pushed by a further piece good of the piece good grouping to this packaging device (and in particular is pushed on and/or relative to the carrier). This means that for example the front most containers of the piece good grouping are pushed by the following ones. In this case in particular these said piece goods, for example containers, bear directly against one another.

For transporting of the containers, the transport device can have a plurality of transport units, which transport the containers in each case partially, in particular in the transport direction. In this case these individual transport units can for example transport the containers from the first packaging device to the second packaging device.

In a further advantageous embodiment these transport units are synchronised with one another, and at least to some extent convey the containers at the corresponding transport speed.

In a further advantageous embodiment, the adapting device has a delivery device which conveys at least one further piece good to the piece good grouping provided with the first wrapping element. In this case this conveying, as mentioned above, can take place perpendicularly to the transport direction or also obliquely or also parallel to the transport direction.

The embodiments described here, or the inventive aspects described here are in each case based on the common concept that the piece good grouping is packaged with two packaging means. In particular the outer packaging means is a stretchable film, with which the piece good grouping is wrapped.

BRIEF DESCRIPTION

Some of the embodiments will be described in detail, with references to the following Figures, wherein like designations denote like members, wherein:

FIG. 1 shows a schematic representation of a machine for packaging piece good groupings;

FIG. 1*a* shows a further view of a machine for packaging piece good groupings;

Figure 5:
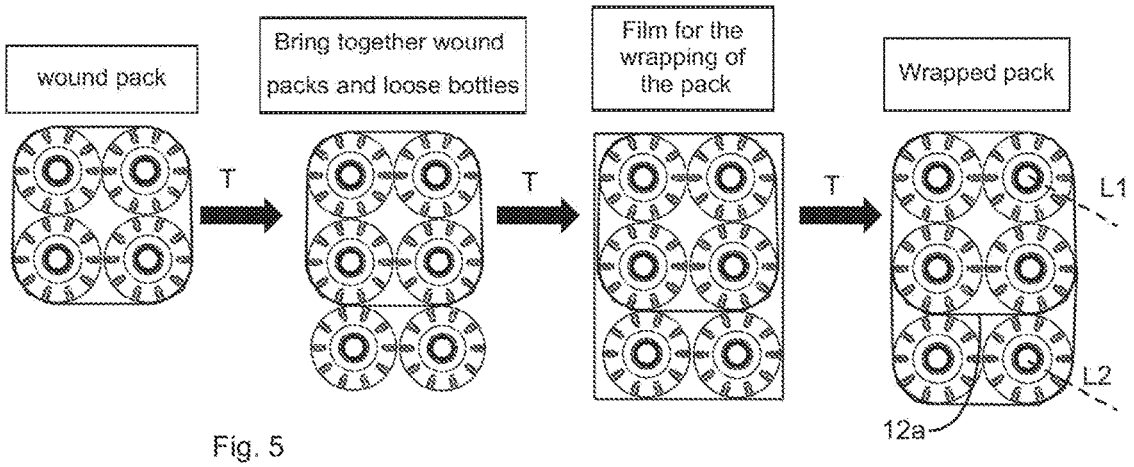
FIG. 5 shows a different representation for illustrating the production of wrapped piece good groupings.
Figure 5A:
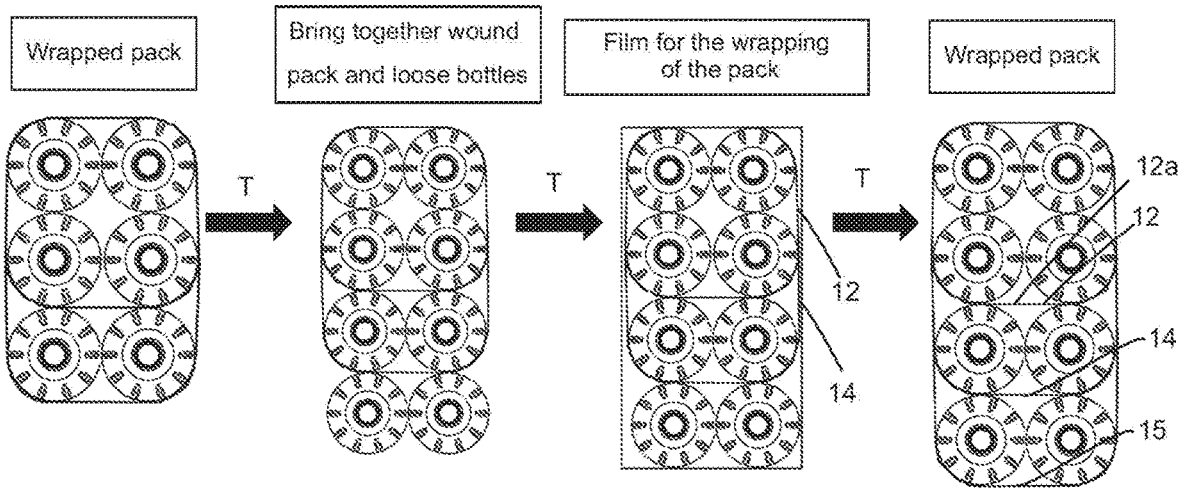
Figure 6:
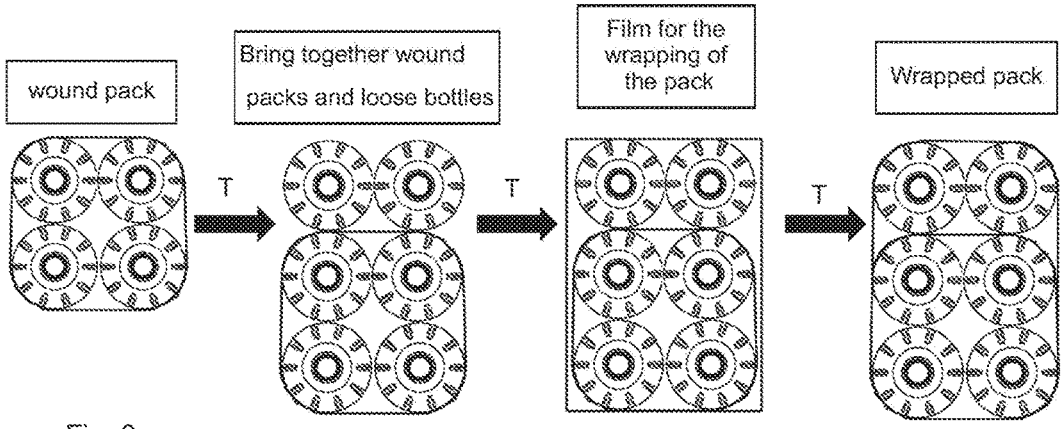
Figure 6A:
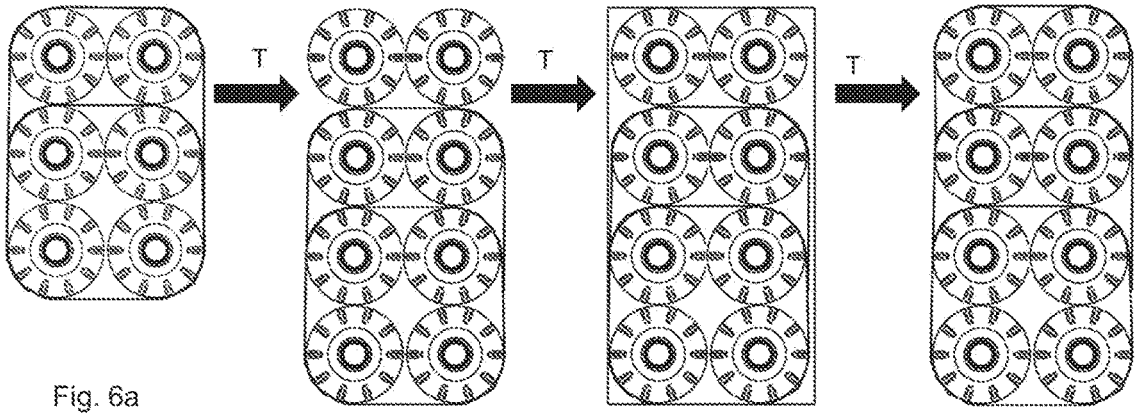
Figure 7:
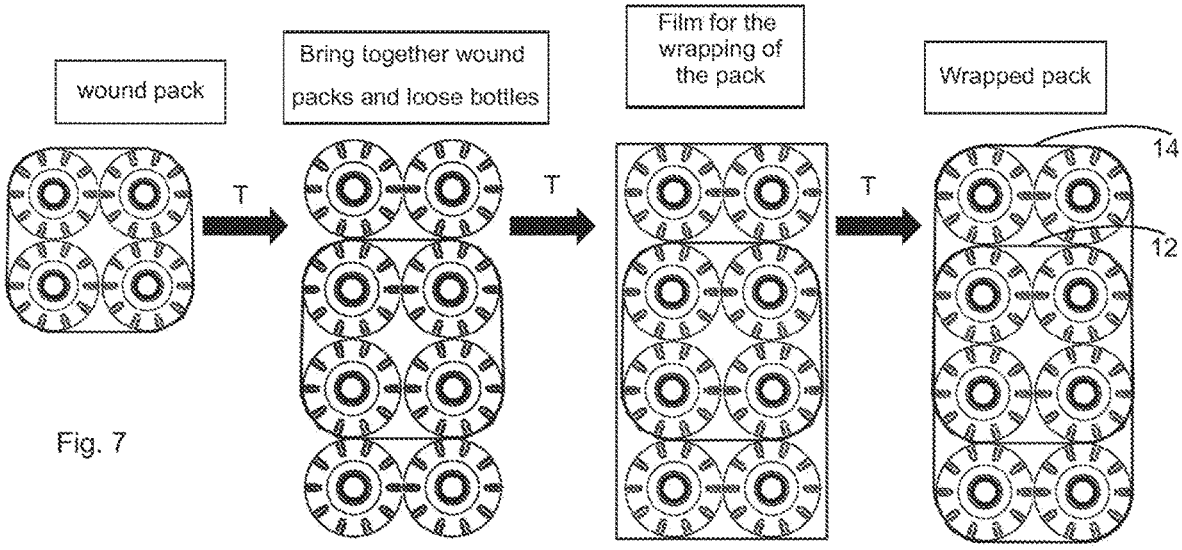
Figure 7A:
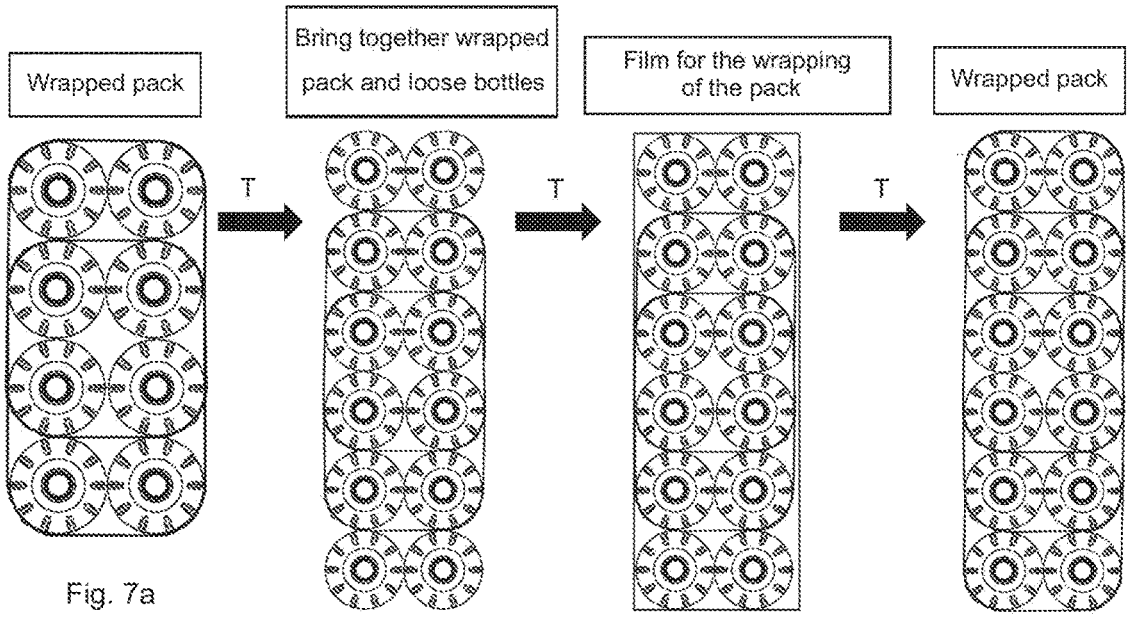
Figure 7B:
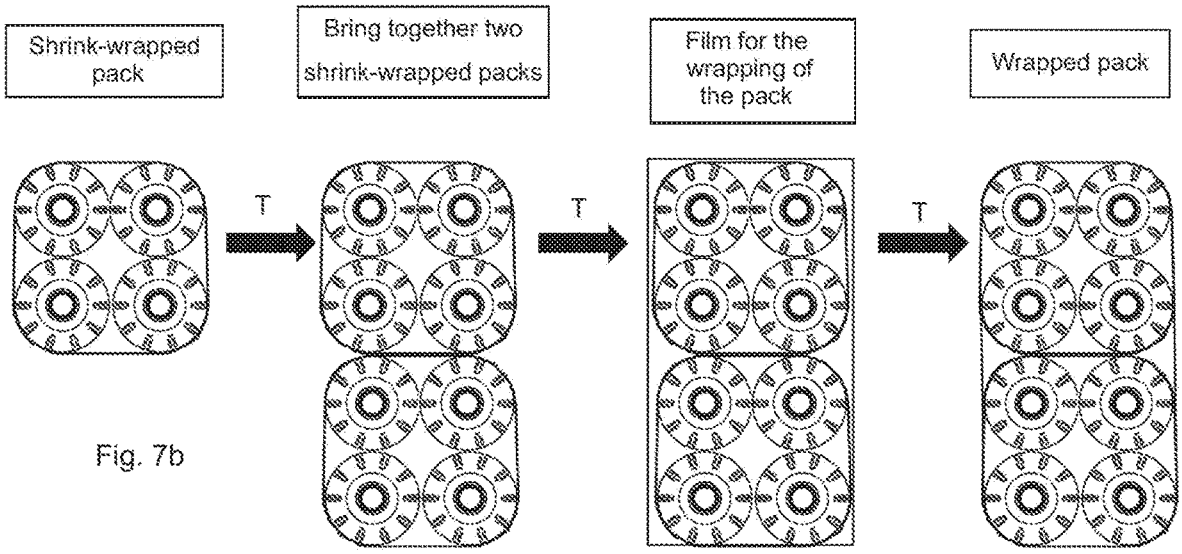
Figure 7C:
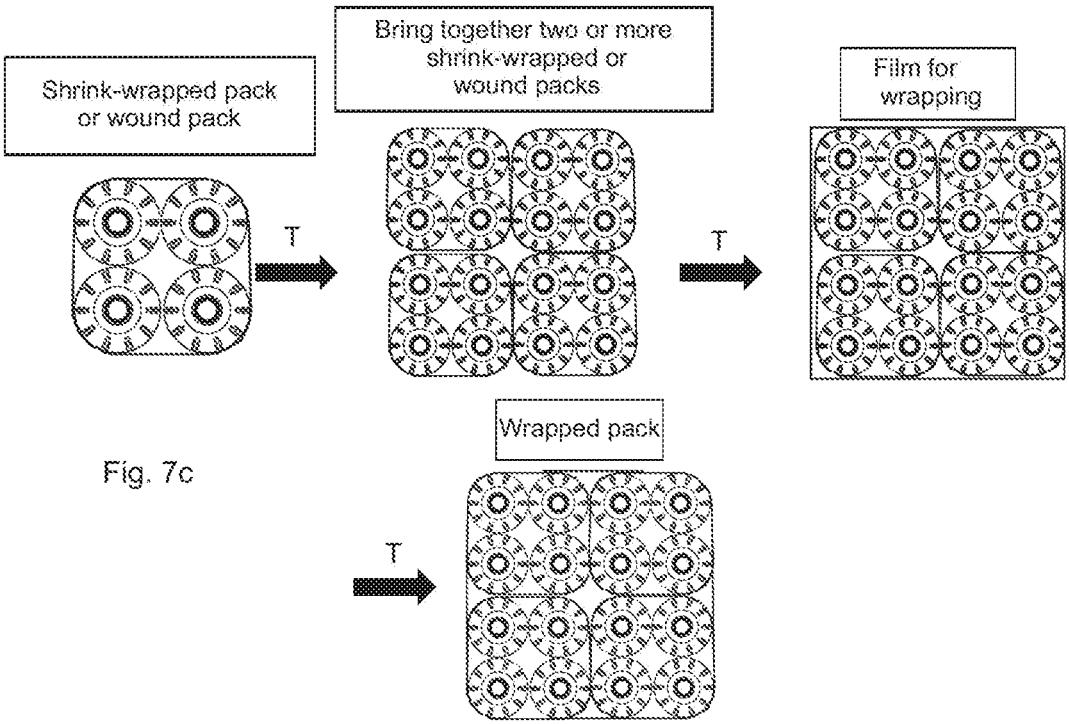
Figure 8:
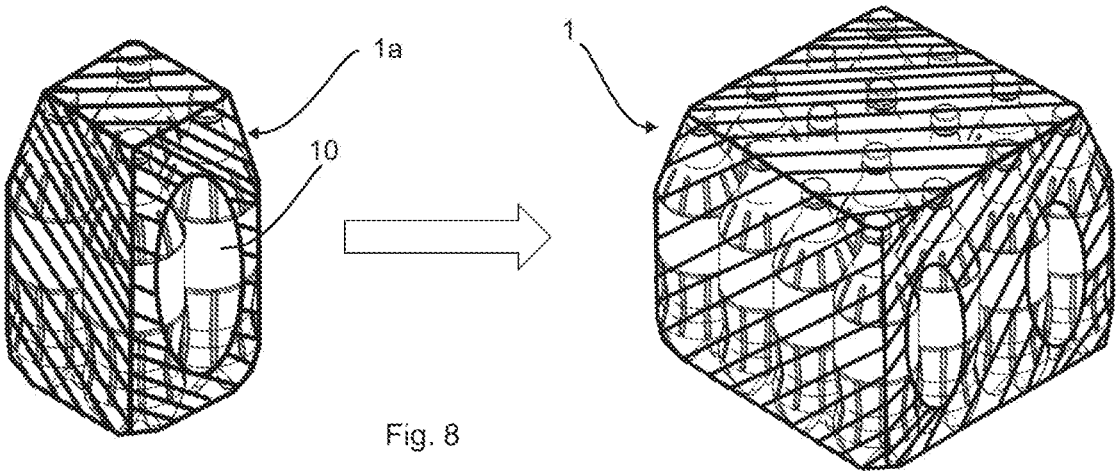
Figure 9:
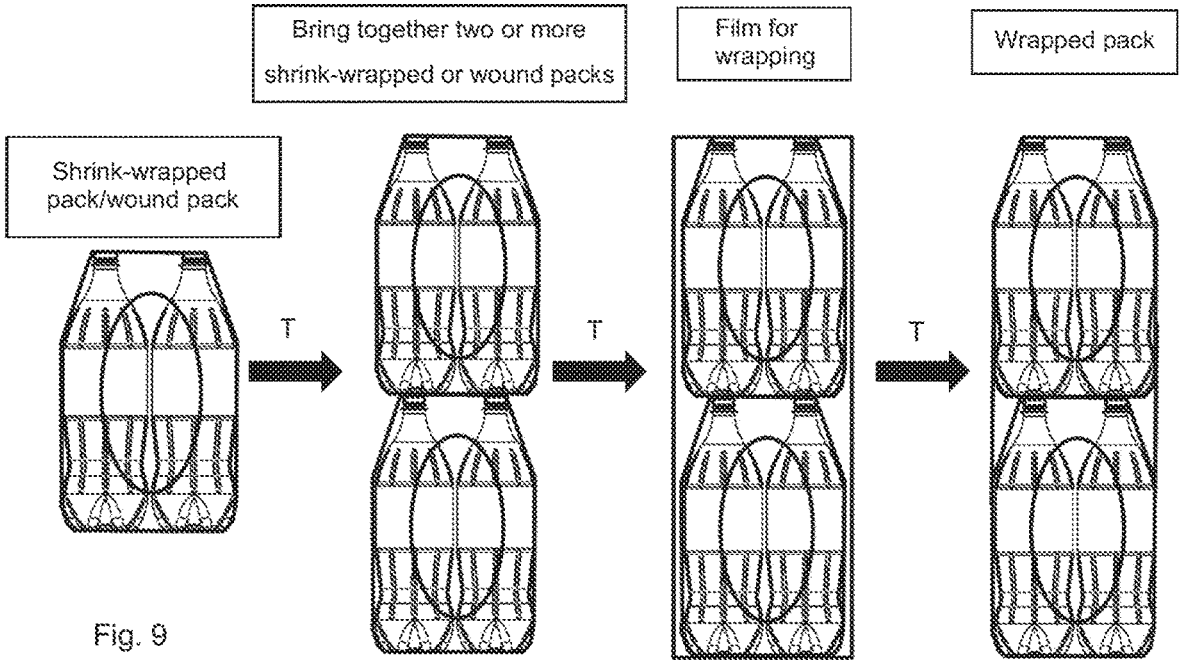
Figure 10:
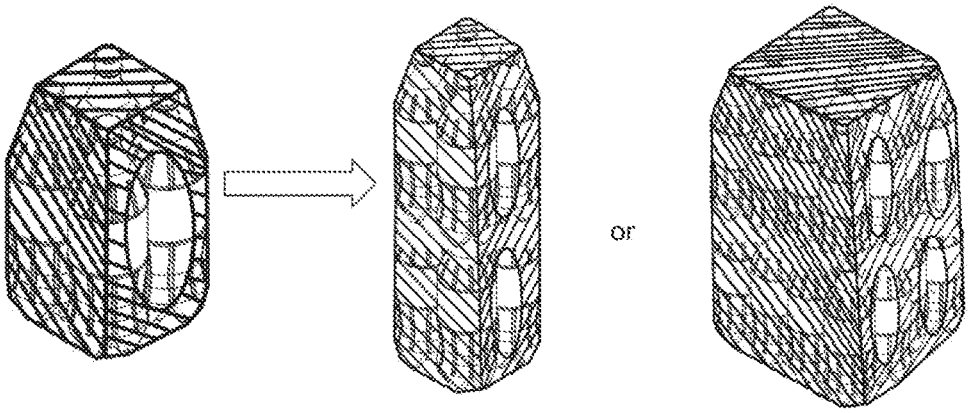
Figure 11:
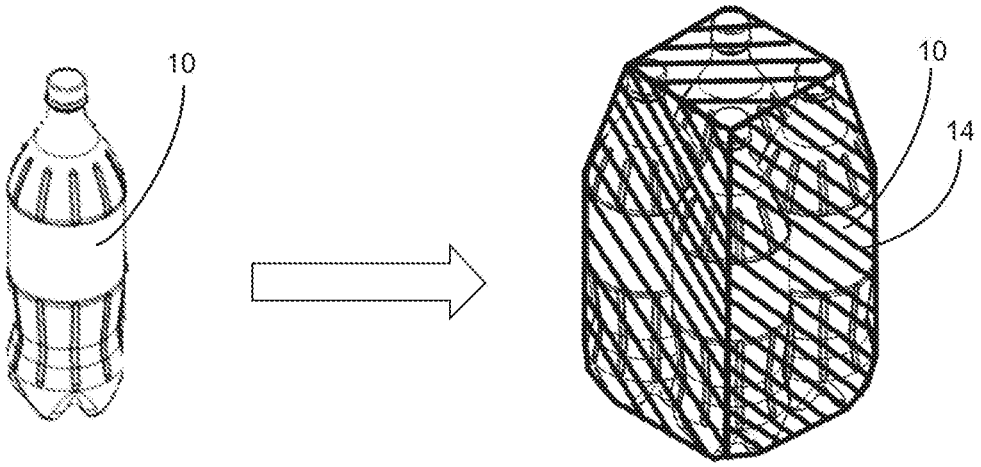
Figure 12:
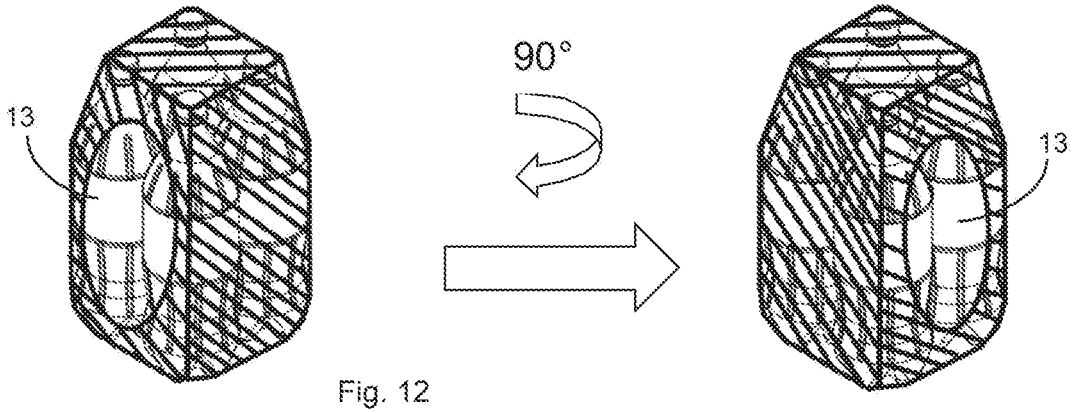
Figure 12A:
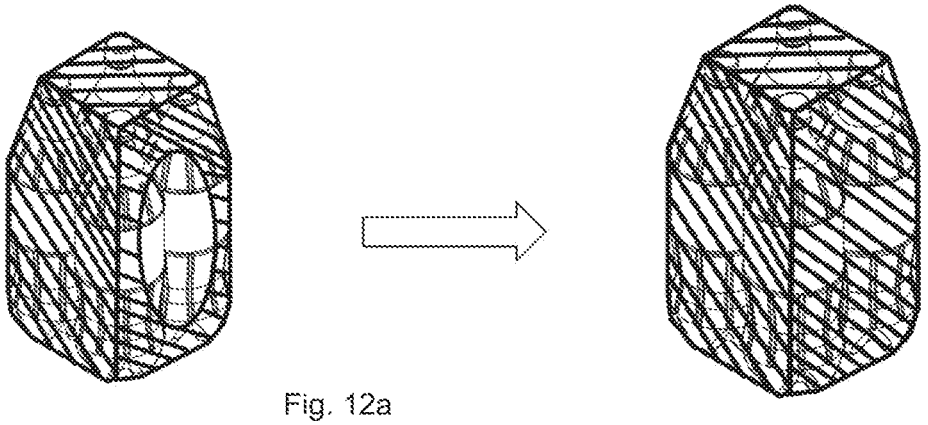
Figure 13:
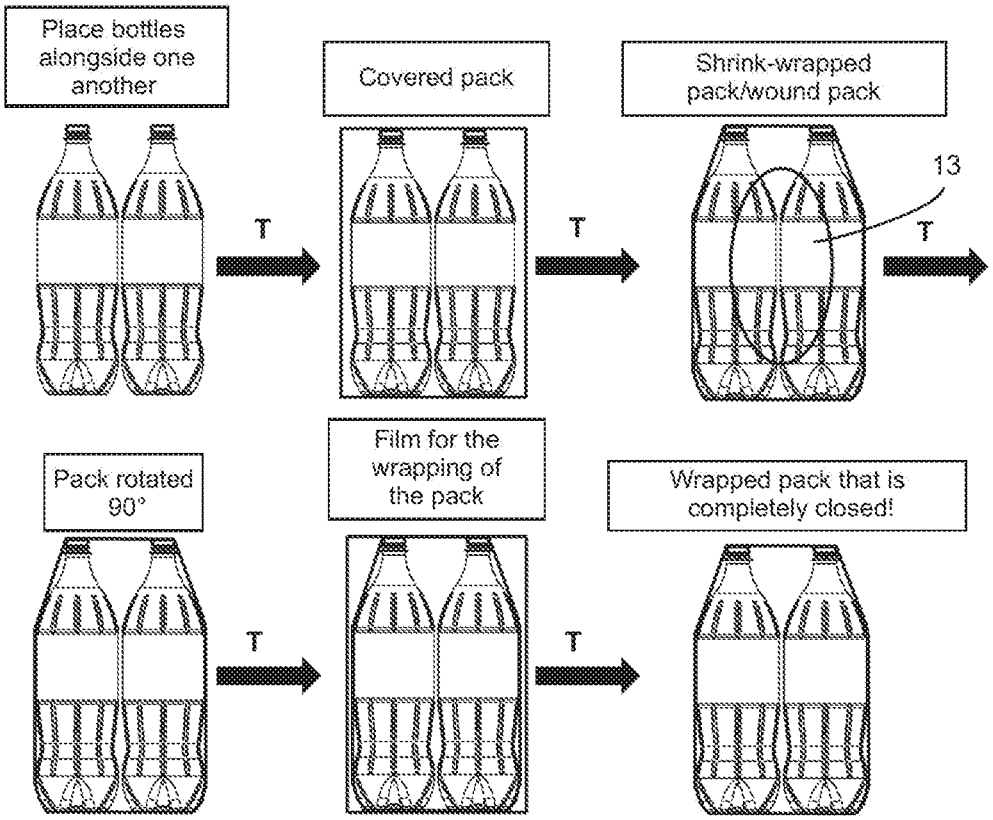
Figure 14:
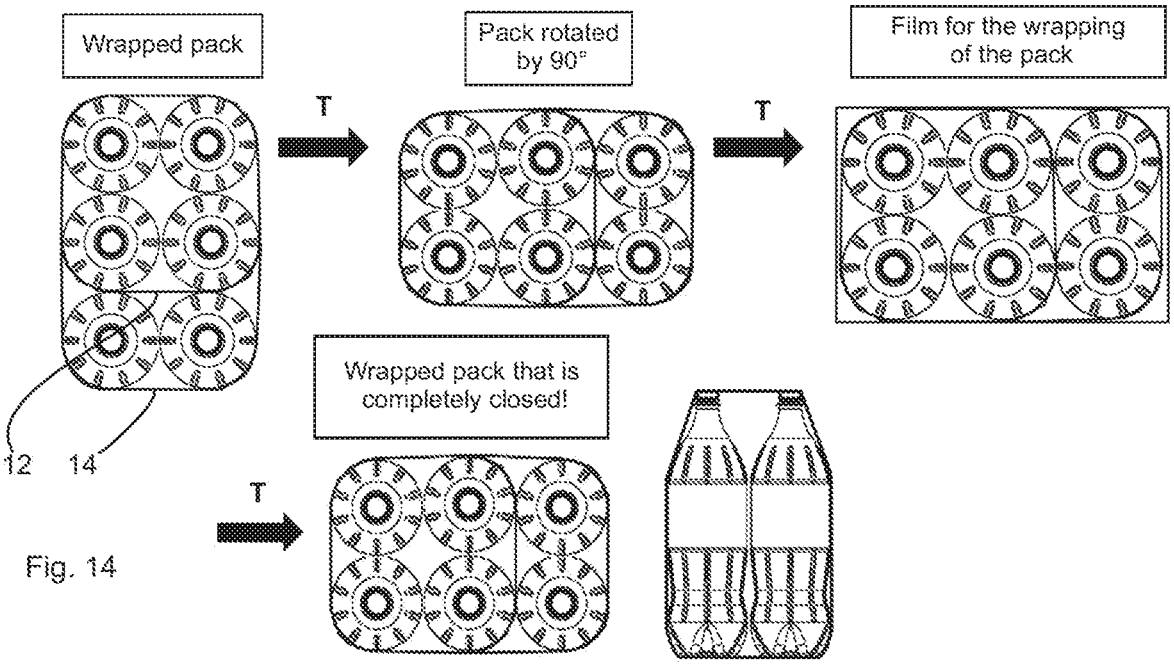
Figure 15:
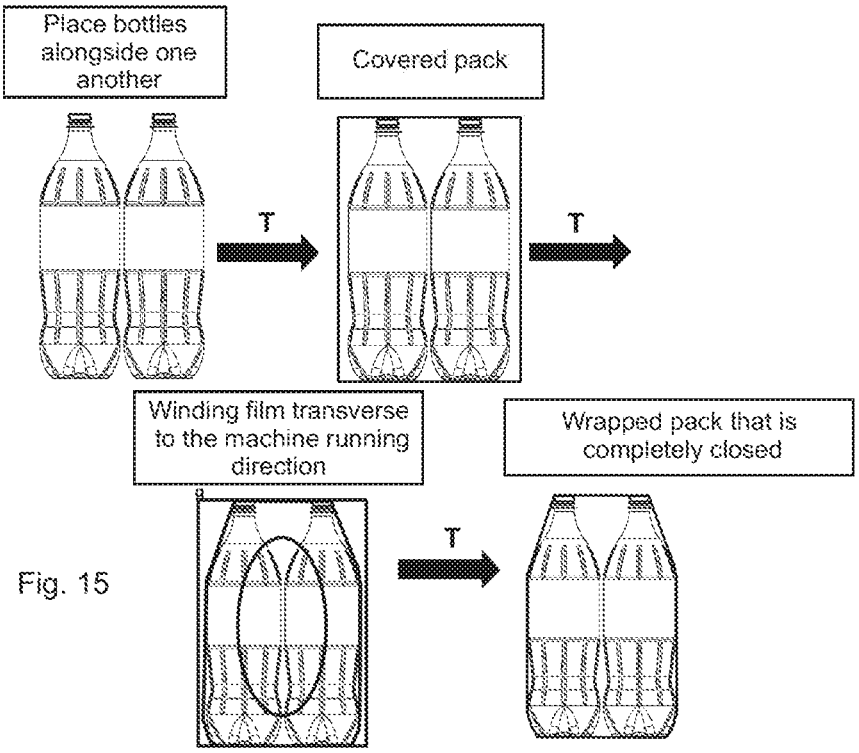
Figure 16:
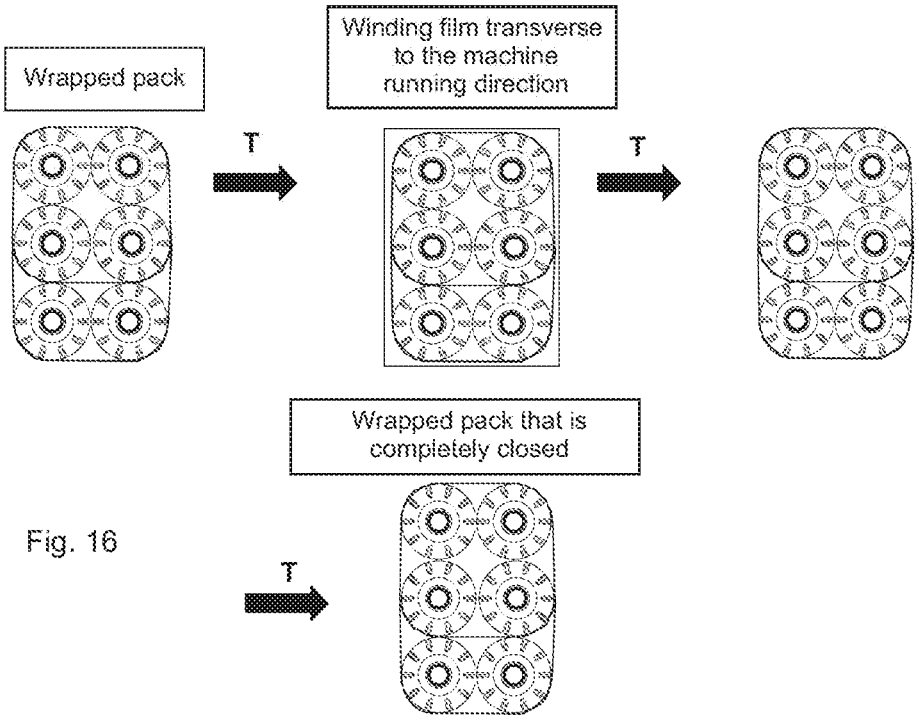
Figure 17:
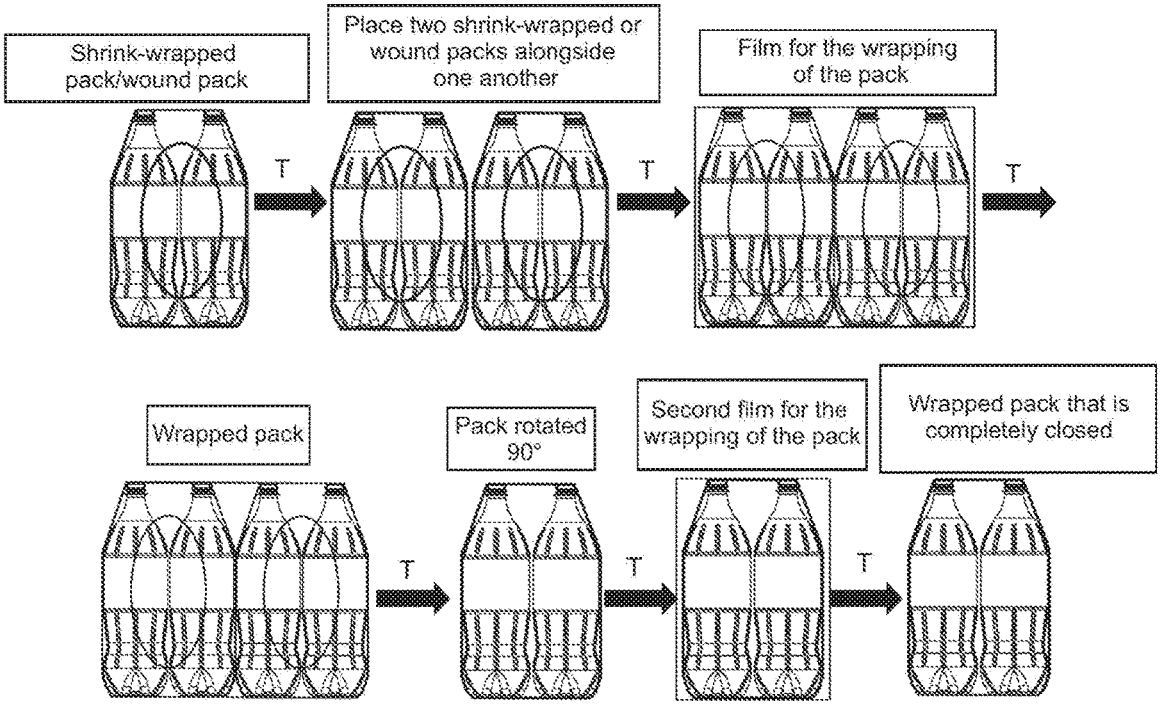
Figure 18:
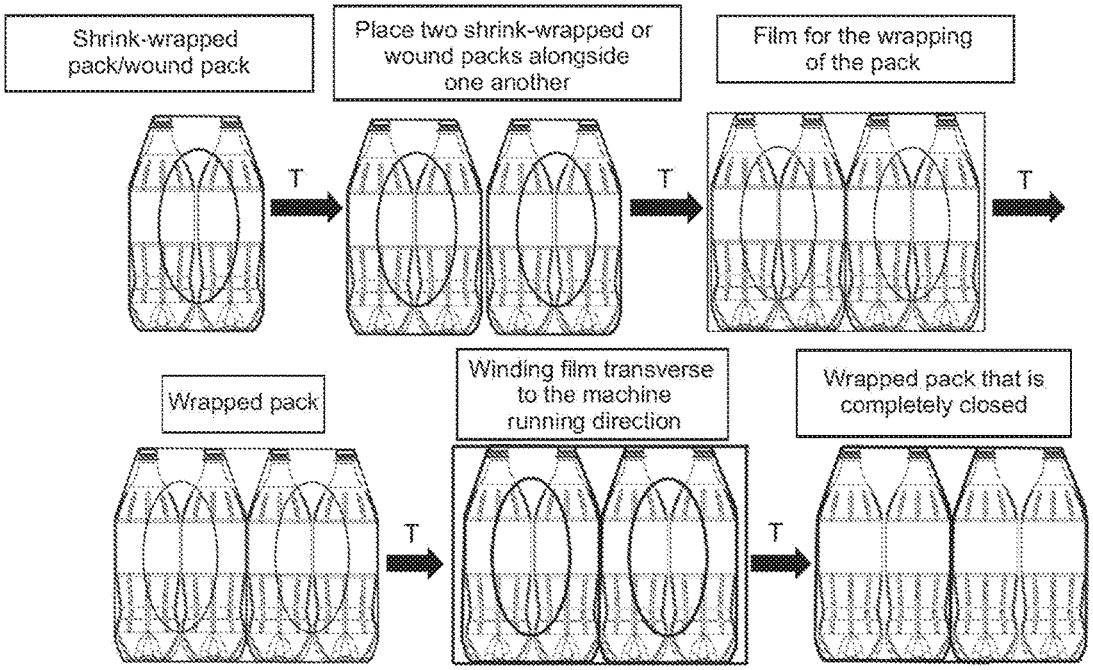
Figure 24:
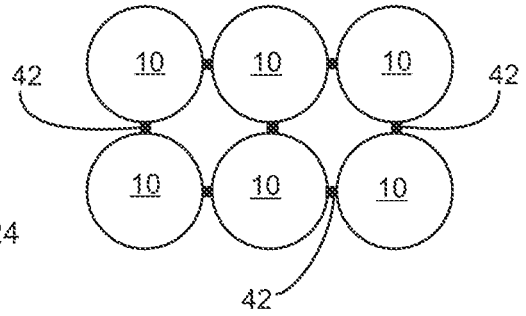
Figure 25A:
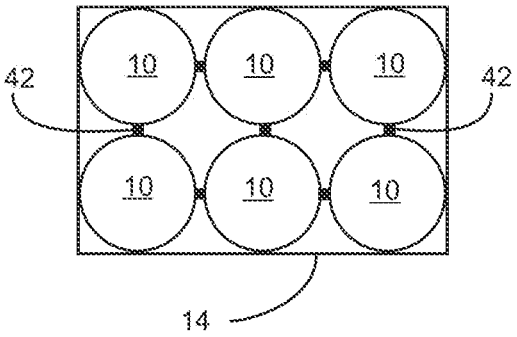
Figure 25B:
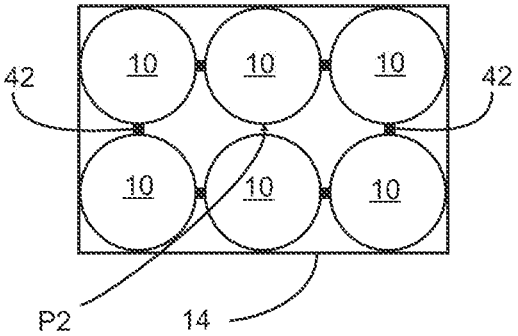
Figure 25C:
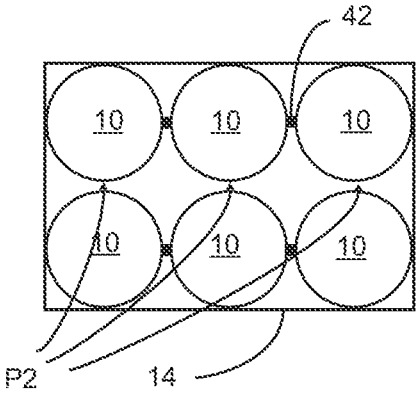
Figure 25D:
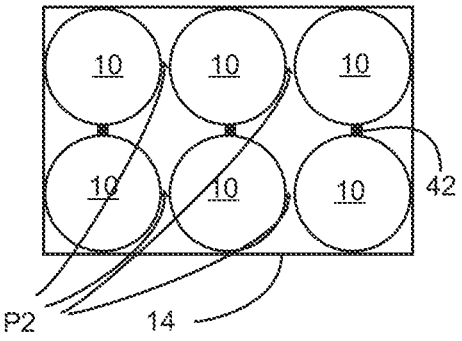

FIG. 5*a* shows a different representation for illustrating the production of wrapped piece good groupings;

FIG. 6 shows a different representation for illustrating the production of wrapped piece good groupings;

FIG. 6*a* shows a different representation for illustrating the production of wrapped piece good groupings;

FIG. 7 shows a different representation for illustrating the production of wrapped piece good groupings;

FIG. 7*a* shows a different representation for illustrating the production of wrapped piece good groupings;

FIG. 7*b* shows a different representation for illustrating the production of wrapped piece good groupings;

FIG. 7*c* shows a different representation for illustrating the production of wrapped piece good groupings;

FIG. 8 shows a further representation for illustrating the production of a piece good grouping;

FIG. 9 shows a representation for the production of a piece good grouping with containers arranged one above the other;

FIG. 10 shows a further representation for illustrating the production of the piece good grouping with containers arranged one above the other;

FIG. 11 shows a schematic representation for illustration of the production of piece good groupings without openings;

FIG. 12 shows a further representation for the production of a piece good grouping without an opening;

FIG. 12*a* shows a further representation for the production of a piece good grouping without an opening;

FIG. 13 shows a further representation for illustrating the production of a wrapped pack;

FIG. 14 shows a representation for the production of a piece good grouping without an opening;

FIG. 15 shows a representation for the production of a piece good grouping without an opening;

FIG. 16 shows a representation for the production of a piece good grouping without an opening;

FIG. 17 shows a representation for the production of a piece good grouping without an opening;

FIG. 18 shows a representation for the production of a piece good grouping without an opening;

FIG. 19 shows a further representation for the production of a piece good grouping without openings;

FIG. 20 shows a further representation for the production of piece good groupings without openings;

FIG. 21 shows a further representation for the production of piece good groupings without openings;

FIG. 22*a* shows a further representation for the production of piece good groupings without openings;

FIG. 22*b* shows a further representation for the production of piece good groupings without openings;

FIG. 23 shows a further representation for the production of piece good groupings without openings;

FIG. 24 shows a further piece good grouping, wherein here the containers are in each case fastened to one another by connector;

FIG. 25*a* shows four representations of the piece good grouping shown in FIG. 24 which is wrapped by a wrapping element;

FIG. 25*b* shows a further representation for the production of piece good groupings without openings;

FIG. 25*c* shows a further representation for the production of piece good groupings without openings; and FIG. 25*d* shows a further representation for the production of piece good groupings without openings;

DETAILED DESCRIPTION

Figure 1:
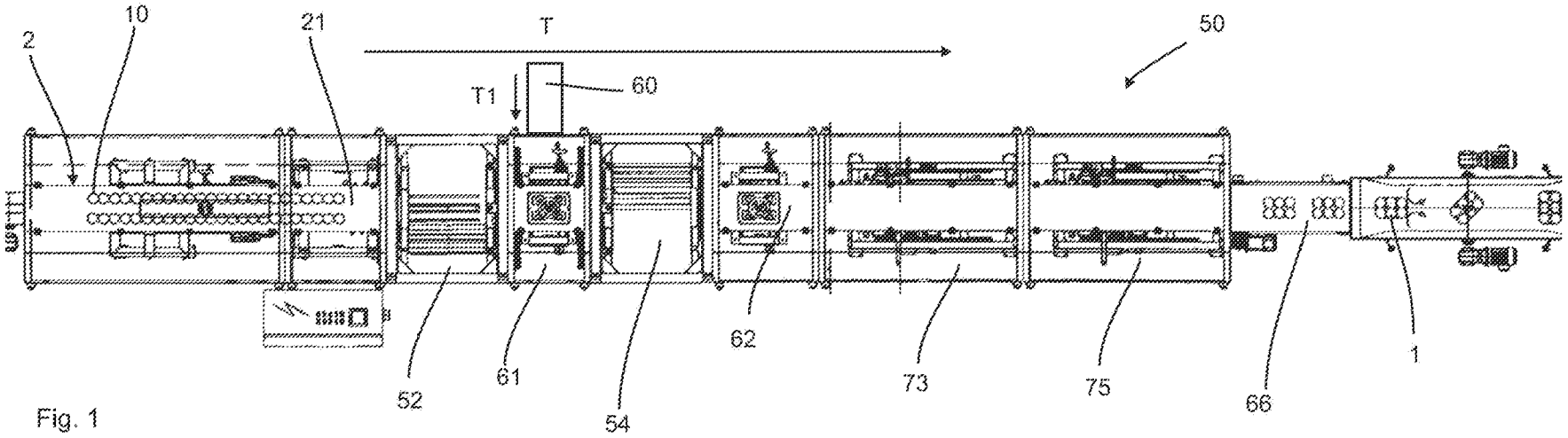

FIG. 1 shows schematically a machine 50 for the production of a piece good grouping 1 and more precisely a schematic plan view of a packaging machine or a portion of a packaging machine. The packaging machine serves here for packaging beverage containers 10. These are delivered along the transport direction T as a stream of articles or piece goods, in this case in a two-track feed, by means of a first horizontal conveying device 21, which in this case is a component of a transport device designated by 2. This horizontal conveying device can be for example a conveyor belt, a mat chain conveyor or the like.

The reference numeral 52 designates a first packaging device in the form of a wrapping device, i.e. a winding module in which the containers are wrapped with at least one layer of a so-called stretch film. In this case this first packaging device 52 can have a roller or a revolving film dispenser which here runs in a circular path around the containers perpendicular to the drawing plane. Unlike the illustration in FIG. 1, however, the two rows of containers 10 are also moved close to one another, so that they are ultimately conveyed and wrapped in contact with one another.

In a manner which is known per se, the stretch film is wound helically around the articles or beverage containers 10 which are conveyed adjacent to one another in pairs, wherein a sufficient tension of the film preferably ensures the firm mechanical cohesion of the stream of articles or piece goods.

In order to ensure the disruption-free transport of the stream of articles or piece goods in the first packaging device 52, revolving feed belts (not shown) can engage for example laterally on the stream of articles or piece goods, which conveys the containers 10 through the first packaging device 52, whilst the containers 10 are simultaneously wrapped. In this case it is conceivable that an operating speed of the first packaging device and/or the second packaging device is at least temporarily and preferably continuously synchronised with a transport speed of the piece goods.

In the first winding module 52 the containers will usually slide onto a lower carrier or a slide plate which is likewise wrapped. In the further course of conveying, however, the already wrapped stream of articles or piece goods is pulled over the sliding plate, so that after leaving this slide plate the stretch film is applied due to its pretension to the underside of the containers.

The reference numeral 61 designates a first feed module which effects the further transport of the stream of articles and piece goods which are now already wrapped here with a layer of film element. In this case this feed unit can for example have upper and lower feed lines or feed belts, which preferably over the length of this first feed module 61 engage continuously on the upper and lower faces of the stream of articles or piece goods and thus ensure further conveying. Here too, lateral guides can again be provided, which support the stream of articles or piece goods on the left and right and guide the stream laterally.

The reference numeral 60 designates quite schematically an adapting device which is designed here as a delivery device which adds further piece goods to the piece good grouping already wrapped with the first wrapping element. In this case this delivery device can have a transport device which delivers these further products for instance laterally. In this case it is conceivable that a conveying speed of this further delivery device is synchronised with a transport speed of the transport device which conveys the containers through the packaging devices 52, 54.

In this way further piece goods can be added in a defined manner in each case to the piece goods wrapped with the first wrapping element. In a further advantageous embodiment this adapting device 60 can also have an advancing device (not shown) which brings the further piece goods so close to the piece goods wrapped with the first wrapping element that they contact these wrapped piece goods and/or the first wrapping element. In this way piece good groupings lying very close together can again be wrapped by the subsequent second packaging device.

In addition, this region can also be provided with an adapting device (not shown) which rotates the piece good grouping, for example in each case by a defined angle of 90° with respect to an axis which is perpendicular to the drawing plane here.

The reference numeral 54 designates a second packaging device, again in the form of a wrapping device, i.e. a winding module, which here winds a second layer of stretch film again helically around the stream of articles or piece goods. Here a winding angle is advantageously changed relative to the winding angle of the first wrapping station 52.

The reference numeral 62 designates a second feed module which effects the further transport of the stream of piece goods which are now wrapped with a plurality of layers of stretch film. For this purpose, upper and lower feed lines or feed belts are again provided, which preferably over the length of the second feed module 62 run around continuously on the upper and lower faces of the stream of articles or piece goods and thus ensure further conveying thereof to the subsequent second horizontal conveying device 73. Cutting elements which cut the winding film can be provided in the region of this conveying device 73 and 75. In this case these cutting elements can at least move with the containers during a cutting operation.

The reference numeral 66 designates a removal device, which removes the now cut pack representation packs or piece good groupings 1.

Figure 1A:
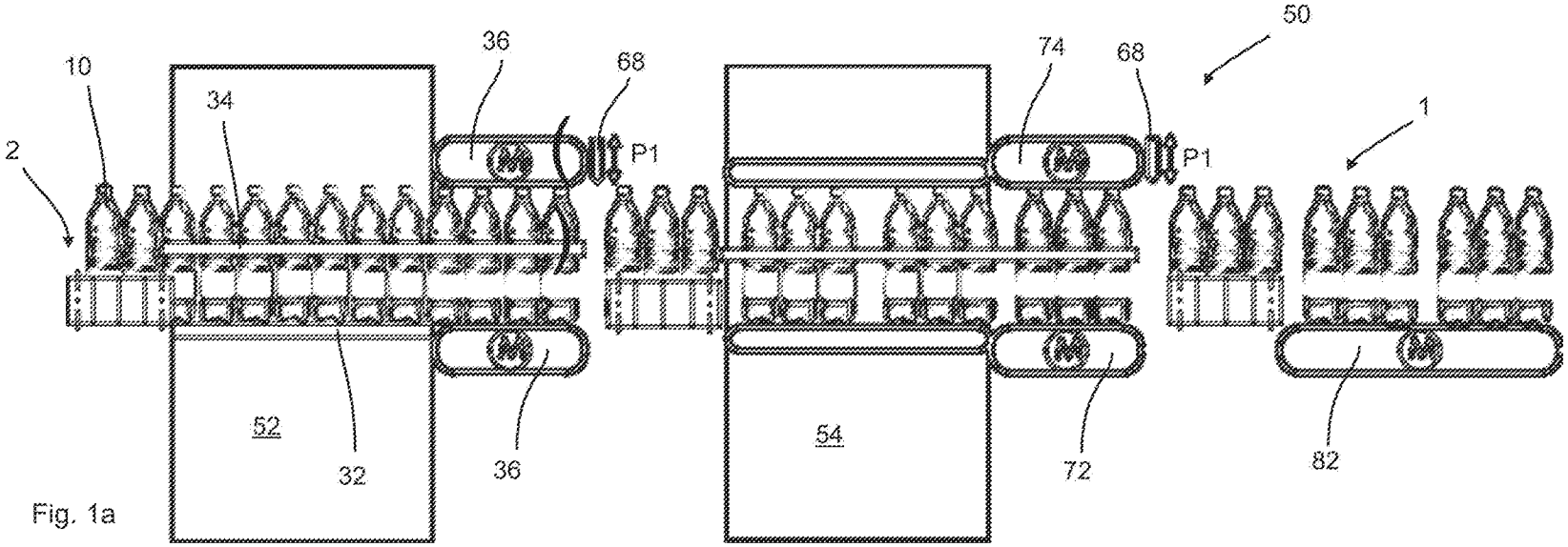

FIG. 1*a* shows a side view of a machine for producing such piece good groupings. Here too, the transport device 2, which first pushes containers 10 onto a stationary carrier plate 32. This means that the containers are pushed by pressure onto the carrier 32. The reference numeral 34 designates lateral guide elements, which cause the containers 10 to be wrapped close together. In the first packaging device 52 the containers 10 are wrapped so that the carrier plate 32 and the lateral guiding element 34 are also included in the wrapping.

The reference numeral 36 designates further transport devices, which convey the now wrapped containers further, that is to say towards the right in FIG. 1*a*. In this way the piece good groupings are also removed again from the carrier 32 and from the lateral guiding elements 34.

The reference numeral 68 designates a first cutting element which in each case cuts off piece good groupings. This can be arranged, as shown by the arrow P1, like a guillotine in a vertical direction. The piece good groupings thus produced are transported into a further wrapping device 54 and there they can likewise be wrapped again with a stretch film. The reference numerals 72 and 74 here designate transport devices which ensure feeding of the piece goods. Between the first winding module and the second winding module the piece good groupings can be rotated, as mentioned above, albeit in FIG. 1*a* about an axis of rotation which extends in the drawing plane.

The reference numeral 68 designates a further cutting element which again serves to cut off the stretch film. The piece good groupings finished in this way can be removed by means of a conveyor belt 82.

Figure 2:
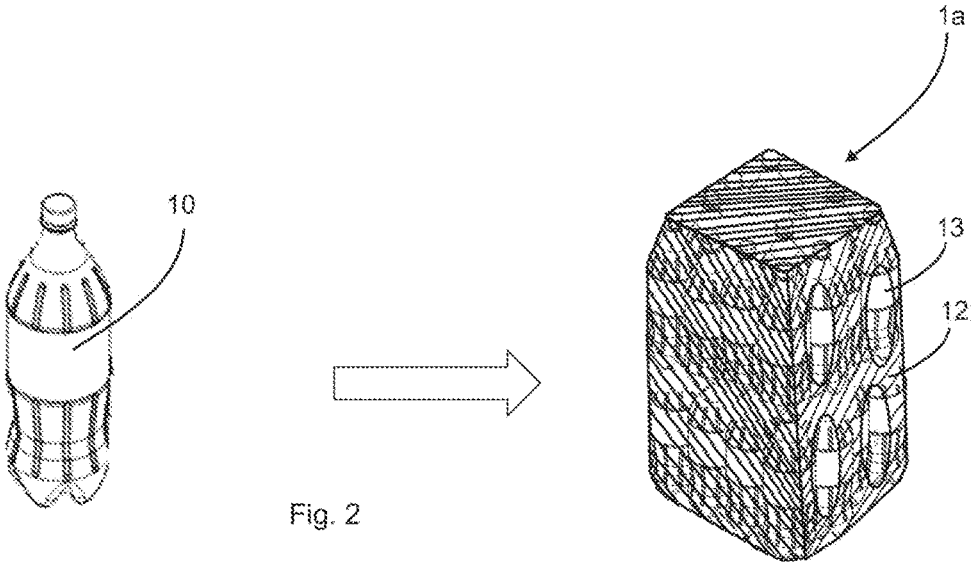
FIG. 2 shows a representation for illustrating the production of a piece good packaging.

FIG. 2 shows a quite schematic representation for illustration of the production of piece good groupings. Ultimately it is possible, as explained more precisely below, first to bind together a plurality of containers 10 into a group and then to wrap them with a wrapping element 12, such as a film in this case. The processing of an individual container 10 to form a container pack, which takes place by a plurality of wrappings, is set out in the following steps.

Figure 3:
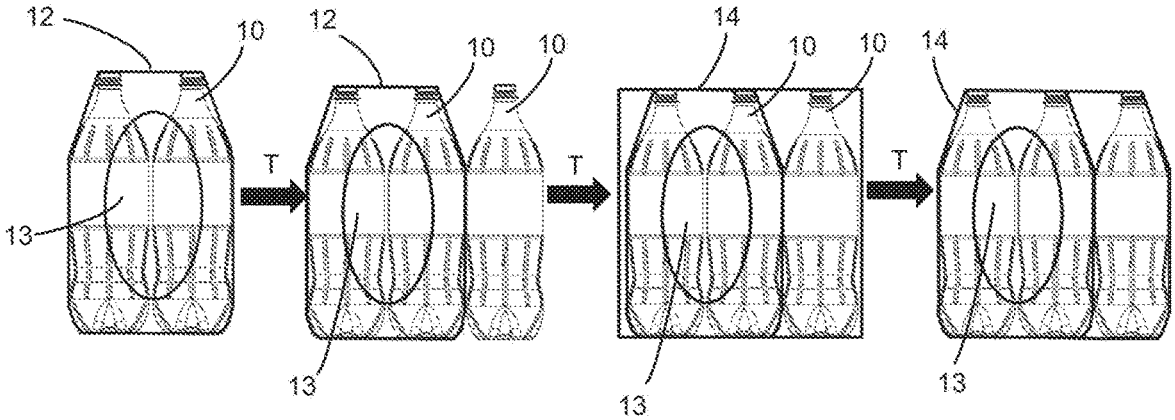
FIG. 3 shows a representation of a method for producing a piece good packaging with the addition of further containers.

FIG. 3 explains a general production process. In this case first a plurality of containers are delivered which are already enclosed by a first wrapping element 12. In this case the reference numeral 13 designates an opening which for example can occur during a shrinking operation. Two further containers 10 (second part-drawing in FIG. 3) are guided towards this first grouping of containers 10. With the second wrapping device (not shown) a film element 14 is attached around this grouping of the first piece good grouping and the two further containers. This film contracts, so that (right part-drawing) ultimately a pack of six containers is produced. This is now a completely wrapped pack.

In this case the film element 12 bears directly against some of the containers (as does the film element 14), in this case against the containers on the left side and only the film element 14 bears against some of the containers, in this case against the containers on the right side. In some regions both film elements bear, for example, against the middle containers.

Figure 4:
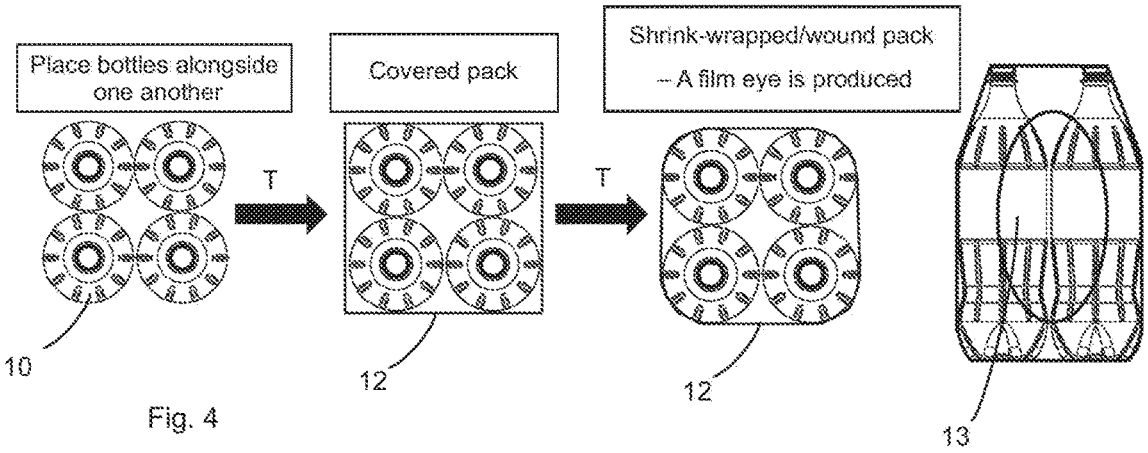
FIG. 4 shows a different representation for illustrating the production of wrapped piece good groupings.

FIG. 4 identifies a first step for a corresponding production process. In this case first, as an example, four containers or generally containers are placed alongside one another and are wrapped by a first wrapping element, in this case likewise a stretch film. A pack thus wound or also shrink-wrapped is produced, as shown in the next part-drawing, wherein here systematic a film opening 13 is produced, as shown in the right part-drawing.

This pack can now be further processed, as shown in FIG. 5. As in the representation shown in FIG. 5, two further containers are delivered to the pack shown in the left part-drawing, and the entire grouping is wrapped again, as shown in the second part-drawing from the right. The stretch film is again applied (cf. right part-drawing), so that a completely wrapped pack with six containers is produced.

In FIG. 5*a* a further process is illustrated. In this case two further containers are delivered to the pack shown in FIG. 5 (right part-drawing) and this grouping is wrapped again. Thus (cf. right part-drawing of FIG. 5*a*) as a result a pack of eight containers is produced which, however, has been included in the wrapping of three film elements here. The portion 12*a* of the first wrapping element, in this case the film element, which extends between containers, can be seen here. The process shown in FIG. 5*a* could still be taken further and in particular successive further piece goods could be added to an already existing piece good grouping. Accordingly, the reference numeral 15 relates to a further film element, which wraps the piece good grouping in addition to the film elements 12 and 14.

The reference numeral L1 designates a geometric radial line, which extends from one of the containers and passes through both wrapping elements. The reference numeral L2 designates a further geometric radial line, which extends from a further one of the containers and passes through only one of the two wrapping elements.

FIG. 6 shows a similar representation to FIG. 5, but with the difference that here two containers are added above the grouping consisting of the four containers and overall are included in the wrapping. Accordingly FIG. 6*a* also shows a similar representation to FIG. 5*a*, wherein here too further containers are added above.

In the situation illustrated in FIG. 7, both above and also below the pack illustrated in the left part-drawing, in each case two bottles are added, and the entire pack is wrapped again. In the representation on the right a pack is produced which is made up of two film elements, specifically an inner film element 12 which surrounds four containers surrounds and an outer film element 14 which surrounds all the containers.

FIG. 7*a* shows a representation, in which further piece goods are added to the piece good grouping produced in FIG. 7 both above and below (i.e. from two sides). This entire grouping is again wrapped with a film element and so a bulk pack is produced with a total of 12 containers here. Thus, it is proposed that the process according to embodiments of the invention for the addition of containers to an already wrapped piece good grouping can also be repeated several times.

FIG. 7*b* shows a further representation for a method according to embodiments of the invention. Here first two shrink-wrapped packs are brought together, and these two shrink-wrapped packs are then wrapped with a film. In this way a pack is produced (cf. right part-drawing) which contains two shrink-wrapped packs which are in each case surrounded by the second film element as winding film.

FIG. 7*c* shows a similar representation to FIG. 7*b*, wherein, however, four such shrink-wrapped packs are wound together and, in this way, (lower part-drawing) a wrapped pack is produced from four shrink-wrapped packs.

FIG. 8 illustrates a further grouping, wherein the number of packs can amount here to at least two pieces or more. The above-mentioned packs are, as mentioned above, formed into large packets by wrapping with film.

FIG. 9 illustrates a further grouping of containers, wherein here two shrink-wrapped packs are placed one above the other and likewise are wrapped again with a film.

FIG. 10 shows that an arrangement of a plurality of shrink-wrapped packs one above the other combined can also be combined with a lateral arrangement, so that the bulk pack illustrated in FIG. 10 is produced.

FIGS. 11 to 23 illustrate the production of containers without openings or eyes. In this connection FIG. 11 illustrates in principle how individual containers 10 can be grouped into opening-free (fully enclosed) container packs. In this case it is possible first, as shown in FIG. 12, to produce a pack which has an opening or a film eye. This pack can then be rotated, for instance by 90°, before the second wrapping unit and can then be wrapped again. Due to this second wrapping the film eye 13 is also closed, so that overall the pack is completely closed, as shown in the right part of FIG. 12*a*.

In FIG. 13 the production of such a pack is likewise illustrated. Here too containers are again placed alongside one another and for example in the second part-drawing are covered with film. In this way, in the third upper part-drawing a shrink-wrapped or wound pack is produced with a film eye 13. This pack is now, as shown in the next part-drawing, rotated by 90° and wrapped again. Lastly (cf. last part-drawing) a wrapped pack which is completely closed is produced.

FIG. 14 shows a combination of the previously illustrated methods. Here again the starting point is also a wrapped pack, which here contains six containers and two film elements 12, 14. This is rotated by 90° and again wrapped with a film. Here too a pack consisting of six containers is produced which, however, is completely closed. In this case this production process can be used for any type of wrapped packs.

FIG. 15 shows a further possible production process. Here too a covered pack is produced and then a winding film is wound on transversely with respect to the machine running direction. Here too (last part-drawing of FIG. 15) a wrapped pack is produced which is completely closed.

FIG. 16 shows a further representation of a described procedure. Here too the starting point is again a wrapped pack, which also here is again wrapped with a winding film transversely with respect to the machine running direction. Also, in this case a wrapped pack is produced which is completely closed. This production process can also be used for any type of wrapped packs.

In the embodiment shown in FIG. 17, first two shrink-wrapped packs or wound packs are provided and placed alongside one another. Next, they are wrapped with film, as shown in the last upper part-drawing. In this way a wrapped pack is produced (lower part-drawing on the left) which is again rotated by 90° (second lower part-drawing of FIG. 17) and is wrapped with a second film. Here too a wrapped pack is again produced which is completely closed and which can have two for example shrink-wrapped or wound packs inside it.

FIG. 18 is similar to the representation shown in FIG. 17, but here there is no rotation of the pack by 90°, but a second winding takes place transversely with respect to the machine running direction. As a result, also a wrapped pack which is completely closed is also produced here.

FIG. 19 again illustrates the production of packs which are completely wrapped.

In the illustration shown in FIG. 20 one or more shrink-wrapped or wound packs are placed one above the other or on one another and again are wrapped with a film. Here too a wrapped pack is produced which, however, has a film eye. This pack is, as illustrated in FIG. 21, rotated by 90° and again wrapped with film, so that as a result a wrapped pack is produced which is completely closed.

FIGS. 22*a* and 22*b* again illustrate in a similar manner the production of a wound pack, wherein here again there is no rotation of the pack, but the second winding film is again applied transversely with respect to the machine running direction. Here too it is pointed out that the shrink-wrapped pack is first delivered in such a way that for example a film eye is located towards the front and so can be wrapped around by the second winding film.

Finally, FIG. 23 illustrates the production of bulk packs from a plurality of containers arranged one above the other.

FIG. 24 shows a further embodiment of a piece good grouping. These has 6 containers here, which are in each case interconnected by connector 42. These connectors can be in particular glued connections. During the production adhesion points can be applied in a targeted manner to the circumferential walls of individual containers and in each case further containers 10 can be adhered thereto. In this way the containers here are not packaged by a surrounding wrapping element, but in each case are in held against one another in particular in pairs. In this way it is already possible to achieve a relatively stable grouping. Precisely, this is a plurality of connector which preferably hold the containers together in each case in pairs.

In the illustration shown in FIG. 25*a* these piece good grouping is now wrapped by a second wrapping element 14. It is pointed out that in these representations, to be precise, the wrapping element 14 is the only wrapping element. However, the term "second wrapping element" has been used here with a view to maintaining uniform terminology. This wrapping element 14 surrounds the piece good grouping here with respect to an axis which extends horizontally. Also, the transport direction along the piece goods are transported extends horizontally here. Nevertheless, a greater stability of the wrapped piece good grouping can be achieved by the wrapping element 14.

FIG. 25*b* shows a further representation of a piece good grouping. It will be recognised here that a connecting element (arrow P2) between the two middle containers has been omitted. This is possible while maintaining sufficient stability, since this stability is still achieved by the surrounding wrapping element 14.

In the illustration shown in FIG. 25*c* a plurality of adhesion points or connecting elements have been omitted. More precisely, the upper row of piece goods here is not adhered to the lower row of piece goods. This is also still acceptable with regard to the required stability because of the additional wrapping. Finally, in the illustration shown in FIG. 25*d* no connection points or connection elements have been affixed between respective laterally adjacent pairs of containers.

It will be recognised that in addition to the illustrated embodiments other groupings are also possible. Also, more containers than illustrated can be grouped together. In addition, further containers could also be added to the piece good groupings shown in FIGS. 25*a-d* and such a grouping can be wrapped again.

In addition, the piece good groupings shown in FIGS. 25*a-d* could also be wrapped again by a further wrapping device, in order thus to again obtain completely closed piece good groupings. In addition, gripping elements could also be fastened to the piece good groupings shown in FIGS. 25*a-d*.

Although the invention has been illustrated and described in greater detail with reference to the preferred exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

LIST OF REFERENCE SIGNS

1 piece good grouping
2 transport device
10 beverage containers
12 first wrapping element
13 opening/film eye
14 film element
15 further film element
21 first horizontal conveying device
32 carrier plate/carrier
34 lateral guide elements
36 further transport devices
42 connecting element
50 machine
52 first packaging device/wrapping device
54 second packaging device/wrapping device
60 adapting device
61 first feed module
62 second feed module
66 removal device
68 cutting element
72, 74 transport devices
73, 75 horizontal conveying device
93 transport belt
T transport direction
P1 arrow

The invention claimed is:

1. A method comprising:

packaging a first plurality of piece goods with a first wrapping element, wherein the first wrapping element at least partially surrounds the first plurality of piece goods;

delivering at least one further piece good to the packaged first plurality of piece goods, wherein the at least one further piece good is a loose piece good; and packaging the first plurality of piece goods and the at least one further loose piece good together with a second wrapping element, wherein the second wrapping element at least partially surrounds both the first wrapping element and the at least one further piece good, wherein the at least one further piece good becomes packaged together with the first plurality of piece goods with the second wrapping element.

2. The method according to claim 1, further comprising:

rotating the first plurality of piece goods before packaging the first plurality of piece goods and the at least one further piece good together with the second wrapping element.

3. The method according to claim 1, wherein the at least one further piece good comprises at least two further piece goods.

4. The method according to claim 3, wherein the at least two further piece goods are oriented parallel to one another and the at least two further piece goods are also oriented parallel to the first plurality of piece goods.

5. The method according to claim 3, wherein the packaging the first plurality of piece goods and the at least one further piece good together with the second wrapping element results in a packaged second plurality of piece goods that comprises the first plurality of piece goods, the at least one further piece good, and the second wrapping element, wherein the packaged second plurality of piece goods are transported onto a carrier in such a way that the at least two further piece goods bear against the first plurality of piece goods.

6. The method according to claim 3, wherein the plurality of piece goods packaged with the first wrapping element are pushed in a predetermined transport direction onto a carrier.

7. The method of claim 2, wherein the packaged first plurality of piece goods has an opening in the first wrapping element, wherein the packaging the first plurality of piece goods and the at least one further piece good together with the second wrapping element results in a second packaged plurality of piece goods that comprises the first plurality of piece goods, the at least one further piece good, and the second wrapping element, and wherein the rotating of the first plurality of piece goods before the packaging the first plurality of piece goods and the at least one further piece good together with the second wrapping element causes the second wrapping element to cover the opening in the first wrapping element, such that the second packaged plurality of piece goods is completely enclosed.

8. The method of claim 4, wherein the packaging the first plurality of piece goods and the at least one further piece good together with the second wrapping element results in a packaged second plurality of piece goods that comprises the first plurality of piece goods, the at least one further piece good, and the second wrapping element, further comprising:

cutting off one or more of the piece goods from the packaged second plurality of piece goods.

9. A method comprising:

packaging a first plurality of piece goods with a first wrapping element, wherein the first wrapping element at least partially surrounds the first plurality of piece goods;

delivering at least one further piece good to the packaged first plurality of piece goods, wherein the at least one further piece good is a loose piece good; and packaging the first plurality of piece goods and the at least one further piece good together with a second wrapping element, such that the at least one further piece good is wrapped by the second wrapping element, but not by the first wrapping element, and wherein the at least one further piece good becomes packaged together with the first plurality of piece goods with the second wrapping element.

10. A method comprising:

packaging a first plurality of piece goods with a first wrapping element, wherein the first wrapping element comprises a stretchable film, and at least partially surrounds the first plurality of piece goods;

delivering at least one further piece good to the packaged first plurality of piece goods, wherein the at least one further piece good is a loose piece good; and packaging the first plurality of piece goods and the at least one further piece good together with a second wrapping element, about a longitudinal axis defined by the transport direction, wherein the second wrapping element comprises a stretchable film.

* * * * *